US009326081B2

(12) United States Patent
Momotani et al.

(10) Patent No.: US 9,326,081 B2
(45) Date of Patent: Apr. 26, 2016

(54) MICROPHONE, ACOUSTIC SENSOR, AND METHOD OF MANUFACTURING ACOUSTIC SENSOR

(71) Applicant: OMRON Corporation, Kyoto-shi, Kyoto (JP)

(72) Inventors: Koji Momotani, Kyoto (JP); Takashi Kasai, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/340,949

(22) Filed: Jul. 25, 2014

(65) Prior Publication Data

US 2015/0043759 A1 Feb. 12, 2015

(30) Foreign Application Priority Data

Aug. 9, 2013 (JP) ..... 2013-165890

(51) Int. Cl.

| | |
|---|---|
| ***H04R 25/00*** | (2006.01) |
| ***H04R 31/00*** | (2006.01) |
| ***H04R 19/00*** | (2006.01) |
| *H04R 19/04* | (2006.01) |

(52) U.S. Cl.

CPC ..... *H04R 31/006* (2013.01); *H04R 19/005* (2013.01); *H04R 19/04* (2013.01); *Y10T 29/49005* (2015.01)

(58) Field of Classification Search

CPC ..... H04R 1/08; H04R 31/00; H04R 19/04; H04R 19/005

See application file for complete search history.

(56) References Cited

U.S. PATENT DOCUMENTS

| | | | | |
|---|---|---|---|---|
| 2007/0047746 | A1 | 3/2007 | Weigold et al. | |
| 2014/0050338 | A1* | 2/2014 | Kasai | H04R 19/04 381/174 |
| 2014/0169594 | A1* | 6/2014 | Zoellin | H04R 19/02 381/190 |
| 2015/0031160 | A1* | 1/2015 | Wang | B81C 1/00158 438/53 |

* cited by examiner

*Primary Examiner* — Tuan D Nguyen
(74) *Attorney, Agent, or Firm* — Osha Liang LLP

(57) ABSTRACT

A microphone has a package, and an acoustic sensor, an under surface of which is fixed to an inner face of the package. The acoustic sensor has a substrate having a plurality of hollows penetrating the substrate from a top surface to an under surface, and a capacitor structure made by a movable electrode plate and a fixed electrode plate disposed above each of the hollows. A package sound hole is opened in the package in a position opposed to the under surface of the acoustic sensor. A dent which is communicated with each of the hollows and open below the under surface side of the substrate is formed below the under surface of the substrate. A height of the dent measured from the under surface of the substrate is equal to or less than half of a height of the hollow.

10 Claims, 27 Drawing Sheets

MICROPHONE, ACOUSTIC SENSOR, AND METHOD OF MANUFACTURING ACOUSTIC SENSOR

CROSS-REFERENCE TO RELATED APPLICATION

This application is based on Japanese Patent Application No. 2013-165890 filed with the Japan Patent Office on Aug. 9, 2013, the entire contents of which are incorporated herein by reference.

FIELD

The present invention relates to a microphone, an acoustic sensor, and a method of manufacturing an acoustic sensor. Specifically, the invention relates to an acoustic sensor of a capacitance type having a plurality of sensing elements (capacitor structure) and a microphone obtained by housing the acoustic sensor in a package. The invention also relates to a method of manufacturing the acoustic sensor.

BACKGROUND

An acoustic sensor of a capacitance type has a structure in which a diaphragm (movable electrode plate) and a fixed electrode plate are provided on a top surface of a hollow (through hole) formed in a substrate. A microphone is obtained by placing an acoustic sensor and a process circuit on a bottom face in a package and forming package sound holes for introducing acoustic oscillation in the package. It is known that, to improve the acoustic characteristics such as sensitivity and frequency characteristic of such a microphone, the capacity of a space (called a back chamber) on the side opposite to the side where the acoustic oscillation enters using the diaphragm as a reference is increased.

In the microphone, generally, package sound holes are formed in the top surface of the package. In a microphone of this type, acoustic oscillation which passes through the package sound holes and enters the package passes through the fixed electrode plate and the diaphragm and enters the hollow. At that time, the acoustic oscillation oscillates the diaphragm to change a capacitance value between the diaphragm and the fixed electrode plate. Therefore, in the microphone, since the hollow in the substrate becomes the back chamber, the capacity of the back chamber cannot be increased so much.

As a practical method for improving acoustic characteristics such as the sensitivity and the frequency characteristic of a microphone, a method of opening a package sound hole in a package in a position where the hole is directly connected to a hollow in a substrate, that is, just below the hollow is proposed (refer to FIG. 1A).

As another method for improving acoustic characteristics such as the S/N ratio (signal-to-noise ratio) and sound pressure band of a microphone, there is a method of providing two acoustic sensors in a microphone. When two acoustic sensors are provided in a single package, by adding outputs of the two acoustic sensors, the sensitivity of the microphone can be improved and noise cancelling can be performed. As a result, the S/N ratio can be improved. By internally providing two acoustic sensors having different sensitivities, different sound pressure bands, different frequency bands, and the like, by using both outputs of the acoustic sensors while switching them in circuits on the post stage, characteristics which cannot be realized by single acoustic sensor can be obtained. For example, by using both an acoustic sensor having high sensitivity and adapted to low sound pressure and an acoustic sensor having low sensitivity and adapted to high sound pressure and switching the acoustic sensors according to the sound pressure bands, a microphone of a wide band having high sensitivity and adapted to high sound pressure can be realized artificially.

As a microphone incorporating a plurality of acoustic sensors, for example, there is a microphone disclosed in U.S. Unexamined Patent Application Publication No. 2007-47746. In the microphone disclosed in U.S. Unexamined Patent Application Publication No. 2007-47746 (FIG. 3A), however, since a plurality of acoustic sensors are disposed on the bottom face of a package and the package sound holes are open in the top surface of the package, the package sound holes cannot be directly connected to the hollows in the acoustic sensors.

As an example of improving the microphone disclosed in U.S. Unexamined Patent Application Publication No. 2007-47746 (FIG. 3A), as illustrated in FIG. 1, a plurality of acoustic sensors 13*a*, 13*b*, . . . independent of one another are mounted on the upper face of the bottom of a package 12 and package sound holes 14 directly connected to hollows 17 are provided in the bottom of the package 12. Since this microphone 11 includes a diaphragm 15 and a fixed electrode plate 16 on the top surface of each of the acoustic sensors 13*a*, 13*b*, . . . , the hollow 17 in the acoustic sensor becomes a front chamber, and a package space 18 in the package becomes a back chamber. Therefore, the capacity of the back chamber can be increased, and the characteristics of the microphone can be improved.

In a microphone of such a structure, however, since a package sound hole is provided for each acoustic sensor, there is the possibility that the acoustic sensors detect acoustic oscillations which enters from the different package sound holes and are slightly different from one another. When output signals of the detected acoustic oscillations which are slightly different from one another are added as described above, for example, there is fear that the output signals interfere one another and buzz occurs. When a plurality of independent acoustic sensors are used as illustrated in FIG. 1, there is the case that manufacture variations among the acoustic sensors become an issue.

On the other hand, in the acoustic sensor disclosed in U.S. Unexamined Patent Application Publication No. 2007-47746 (FIG. 4), as illustrated in FIG. 2, the fixed electrode plate 16 is provided on the top surface of a substrate 22, a plurality of diaphragms 15 are provided above the fixed electrode plate 16, and a plurality of sensing elements 21*a*, 21*b*, . . . (capacitor structure) are formed by the diaphragms 15 and the fixed electrode plate 16. In each of the sensing elements 21*a*, 21*b*, acoustic holes 23 are open in the fixed electrode plate 16. In the acoustic sensor 13 as illustrated in FIG. 2, the plurality of sensing elements 21*a*, 21*b*, . . . are formed in the single substrate, so that manufacture variations of the sensing elements are small. Therefore, it is considered to form one package sound hole in the package so as to be directly connected to the under surface of the hollow 17 by using the acoustic sensor 13 as illustrated in FIG. 2.

In the acoustic sensor 13 of FIG. 2, as it is convenient that the sensing elements 21*a*, 21*b*, . . . share the hollow 17, the hollow 17 extends in the entire space below the sensing elements 21*a*, 21*b*, . . . . On the other hand, in the hollow 17, a reinforcing member (stiffening rib) 24 is provided by the substrate 22 in an upper part of the hollow 17.

However, since the stiffening rib 24 is an etching residual at the time of forming the hollow 17 in the substrate 22 by etching and is a member which is much thinner than the substrate 22, sufficient strength cannot be given to the acoustic sensor 13 by the stiffening rib 24 itself. Consequently, the substrate 22 is distorted by an impact given when the microphone is dropped, and the diaphragm 15 is easily broken.

In the acoustic sensor 13 of FIG. 2, the etching volume at the time of forming the hollow 17 in the substrate 22 is large, so that the etching time is long, and the productivity of the acoustic sensor is low. Further, in the acoustic sensor 13, the hollows 17 below the sensing elements 21*a*, 21*b*, . . . are connected. Consequently, the acoustic oscillation which enters the hollows 17 easily escapes from the entire sensing element, and the low-frequency characteristic of the acoustic sensor 13 deteriorates.

In the acoustic sensor 13 of FIG. 2, the position of providing the package sound hole is limited to the opening area in the under surface of the hollow 17, so that the freedom degree for designing the position of the package sound hole is low, and a foreign matter such as dust easily enters the hollow 17 from the package sound hole.

In the acoustic sensor of U.S. Unexamined Patent Application Publication No. 2007-47746 (FIG. 4), a partition wall 25 is constructed by extending the stiffening rib 24 to the under surface of the substrate 22, and the hollows 17 can be partitioned by the partition wall 25. By forming a communication hole 26 at a height in a center part of the partition wall 25, the neighboring hollows 17 are communicated (indicated by a broken line in FIG. 2). However, in such a modification, the communication hole 26 has to be formed so as to laterally penetrate the partition wall 25 in the center part of the partition wall 25, so that the process of opening the communication hole 26 is extremely difficult. Further, when the partition wall 25 is provided but the communication hole 26 is not provided, a package sound hole has to be formed for each of the hollows 17, and an inconvenience similar to that of the case of FIG. 1 occurs.

SUMMARY

According to one or more embodiments of the present invention is, in an acoustic sensor and a microphone in which a package sound hole is directly connected to a hollow provided in a substrate and the hollow is used as a front chamber, strength of the substrate is improved, time of etching at the time of forming the hollow is shortened, and the low-frequency characteristic is made excellent. One or more embodiments of the present invention improves the productivity of the acoustic sensor.

In a microphone according to one or more embodiments of the present invention, in which an under surface of an acoustic sensor is fixed to an inner face of a package, the acoustic sensor includes a substrate having a plurality of hollows penetrating the substrate from the top surface to the under surface, and a capacitor structure made by a movable electrode plate and a fixed electrode plate disposed above each of the hollows. A package sound hole is opened in the package in a position opposed to the under surface of the acoustic sensor, a dent which is communicated with each of the hollows and open below the under surface side of the substrate is formed below the under surface of the substrate, and height of the dent measured from the under surface of the substrate is equal to or less than the half of the height of the hollow.

The microphone according to one or more embodiments of the present invention has a structure of taking acoustic oscillation from the package sound hole into the hollows in the acoustic sensor, so that the space in the package becomes a back chamber, and a wide back chamber space is provided. One substrate is provided with a plurality of capacitor structures (sensing elements). Therefore, the microphone has excellent acoustic characteristics such as sensitivity and frequency characteristic. Moreover, in the microphone according to one or more embodiments of the present invention, the dent which is communicated with each of the hollows and is open below the under surface side of the substrate is formed in the under surface of the substrate, and the height of the dent measured from the under surface of the substrate is equal to or less than the half of the height of the hollows. Consequently, the rigidity of the substrate is high. As a result, even when an impact due to drop or the like is applied to the microphone, the substrate is not easily deformed, and the movable electrode plate is not easily damaged by an impact. Since the etching volume of the substrate is small, the substrate etching time is shortened, and the productivity of the acoustic sensor improves. Further, since the hollows are almost independent, the acoustic vibration which enters the hollows does not easily escape, so that the low-frequency characteristic of the acoustic sensor is excellent.

In a microphone according to one or more embodiments of the present invention, the hollows are separated from each other by a partition wall of the substrate, the dent is formed at least in a portion of the under surface of the partition wall in the under surface of the substrate, and the dent is communicated with a side face of a lower end of each of the hollows. Although the dent is formed at least in a portion of the under surface of the partition wall, it may be provided in a region other than the under surface of the partition wall. In one or more embodiments of the present invention, since the hollows in the substrate are held by the partition walls and the dent below the partition wall is equal to or less than the half of the height of the hollow, the rigidity of the substrate is high. As a result, even when an impact due to drop or the like is applied to the microphone, the substrate is not easily deformed, and the movable electrode plate is not easily damaged by an impact. Since the height of the dent is equal to or less than the half of the hollow, the etching volume of the substrate is small, the substrate etching time is shortened, and the productivity of the acoustic sensor improves. Further, since the hollows are partitioned by the partition walls and are almost independent, the acoustic vibration which enters the hollows does not easily escape, so that the low-frequency characteristic of the acoustic sensor is excellent. Since the package sound hole can be formed in an arbitrary position as long as the position is in a portion where there is a dent or hollow in the under surface of the substrate, the freedom degree of designing the microphone improves.

In a microphone according to one or more embodiments of the present invention, the package sound hole is opposed to the under surface of the partition wall. In one or more embodiments of the present invention, since the under surface of the partition wall exists above the package sound hole, intrusion of a foreign matter, disturbance, and the like from the package sound hole into the acoustic sensor is suppressed.

In a microphone according to one or more embodiments of the present invention, a supporting column is projected from a portion of the under surface of the partition wall. In one or more embodiments of the present invention, the rigidity of the substrate is higher, and the strength of the acoustic sensor increases. Since the substrate etching volume becomes smaller, the substrate etching time becomes shorter. In particular, according to one or more embodiments of the present invention, the under surface of the supporting column is positioned in the same plane as the under surface of the substrate.

The package sound hole may be opposed to the under surface of any one of the plurality of hollows.

In a microphone according to one or more embodiments of the present invention, the hollows are separated from one another by the partition walls of the substrate, the dent is formed at least in a portion of the under surface of a region other than the hollows and the partition walls in the under surface of the substrate, and the dent is communicated with a side face of a lower end of each of the hollows. In one or more embodiments of the present invention, the freedom degree of the position of the package sound hole is higher. The package sound hole may be opposed to the under surface of the region other than the hollows and the partition walls.

In a microphone according to one or more embodiments of the present invention, the entire periphery of the dent is surrounded by the substrate. In one or more embodiments of the present invention, leakage of the acoustic oscillation which enters from the package sound hole into the dent can be prevented, so that the sensitivity of the acoustic sensor improves.

An acoustic sensor according to one or more embodiments of the present invention includes a substrate having a plurality of hollows penetrating the substrate from the top surface to the under surface and a capacitor structure made by a movable electrode plate and a fixed electrode plate disposed above each of the hollows. A dent which is communicated with each of the hollows and open below the under surface side of the substrate is formed in the under surface of the substrate, and height of the dent measured from the under surface of the substrate is equal to or less than the half of the height of the hollow.

The acoustic sensor according to one or more embodiments of the present invention has a structure of taking acoustic oscillation from the package sound hole into the hollows in the acoustic sensor, so that a wide back chamber space can be assured. One substrate is provided with a plurality of capacitor structures (sensing elements). Therefore, the acoustic sensor has excellent acoustic characteristics such as sensitivity and frequency characteristic. Moreover, in the acoustic sensor according to one or more embodiments of the present invention, the dent which is communicated with each of the hollows and is open below the under surface side of the substrate is formed in the under surface of the substrate, and the height of the dent measured from the under surface of the substrate is equal to or less than the half of the height of the hollows. Consequently, the rigidity of the substrate is high. As a result, even when an impact due to drop or the like is applied to the acoustic sensor, the substrate is not easily deformed, and the movable electrode plate is not easily damaged by an impact. Since the etching volume of the substrate is small, the substrate etching time is shortened, and the productivity of the acoustic sensor improves. Further, since the hollows are almost independent, the acoustic vibration which enters the hollows does not easily escape so that the low-frequency characteristic of the acoustic sensor is excellent.

A first manufacturing method of an acoustic sensor according to one or more embodiments of the present invention is an acoustic sensor manufacturing method for manufacturing the acoustic sensor and includes: a first step of fabricating a structure for forming a movable electrode plate and a fixed electrode plate on a top surface of a substrate material having a flat plate shape; a second step of forming a first mask having an opening in a region corresponding to the under surface of the hollows and the dent, on the under surface of the substrate material; a third step of forming a second mask covering the region corresponding to the under surface of the dent and having an opening at least in a region corresponding to the under surface of the hollows, on the under surface of the substrate material and the first mask; a fourth step of forming a recess having a depth equal to a value obtained by subtracting height of the dent from height of the hollow, in a region which becomes the hollow in the substrate material by dry-etching the substrate material from the under surface side via the first and second masks; a fifth step of forming the substrate having the hollows and the dent by removing the substrate material in a region which becomes the hollows and the dent of the substrate material only by the same depth as the height of the dent by dry-etching the substrate material from the under surface side through the first mask in a state where there is no second mask; and a sixth step of forming the movable electrode plate and the fixed electrode plate on the top surface of the substrate by the structure. By the first manufacturing method of the acoustic sensor according to one or more embodiments of the present invention, the acoustic sensor can be manufactured.

In the first manufacturing method of the acoustic sensor according to one or more embodiments of the present invention, in the third step, when thickness of the substrate is expressed as A, height of the dent is expressed as H, and ratio of etching rate of the second mask to etching rate of the substrate material is expressed as R2, thickness T of the second mask is determined as $T=(A-H)\times R2$. In one or more embodiments of the present invention, the fourth and fifth steps can be continuously processed in the dry etching device, so that the productivity of the acoustic sensor improves.

Further, in the third step, the dry etching may be stopped in a state where the second mask remains, and the residual second mask may be removed by ashing. In one or more embodiments of the present invention, the height of the dent is not easily influenced by variations in the thickness of the second mask.

In the first manufacturing method of the acoustic sensor according to one or more embodiments the present invention, in the second step, when height of the dent is expressed as H and the ratio of the etching rate of the first mask to the etching rate of the substrate material is expressed as R1, thickness "t" of the first mask is determined as $t \geq H\times R1$. In one or more embodiments of the present invention, the first mask can be prevented from being exhausted by the dry etching before the hollows are formed in the substrate. Particularly, when the thickness of the first mask is expressed as $t=H\times R1$, the first mask is exhausted by the dry etching when the hollows are formed in the substrate. Consequently, the process of peeling off the first mask becomes unnecessary.

A second manufacturing method of an acoustic sensor according to one or more embodiments of the present invention is an acoustic sensor manufacturing method for manufacturing the above-described acoustic sensor and includes: a first step of fabricating a structure for forming a movable electrode plate and a fixed electrode plate on a top surface of a substrate material having a flat plate shape; a second step of forming a third mask having an opening in a region corresponding to the under surface of the hollows and the dent, on the under surface of the substrate material; a third step of forming a recess having a depth equal to height of the dent, in a region which becomes the hollows and the dent in the substrate material by etching the substrate material from the under surface side via the third mask; a fourth step of covering the region which becomes the dent in the top surface of the recess and side wall faces of the recess with a fourth mask; a fifth step of forming the substrate having the hollows and the dent by etching a region which becomes the hollows of the substrate material from the under surface side via the third and fourth masks; and a sixth step of forming the movable electrode plate and the fixed electrode plate on the top surface of the substrate by the structure. Also by the second manufacturing method of the acoustic sensor according to one or more embodiments of the present invention, an acoustic sensor can be manufactured.

The present invention can have many variations by the combination of the components.

DETAILED DESCRIPTION

Embodiments of the present invention will be described below with reference to the appended drawings. The present invention, however, is not limited to the following embodiments but can be variously designed and changed without departing from the gist of the invention. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Structure of First Embodiment

Figure 3A:
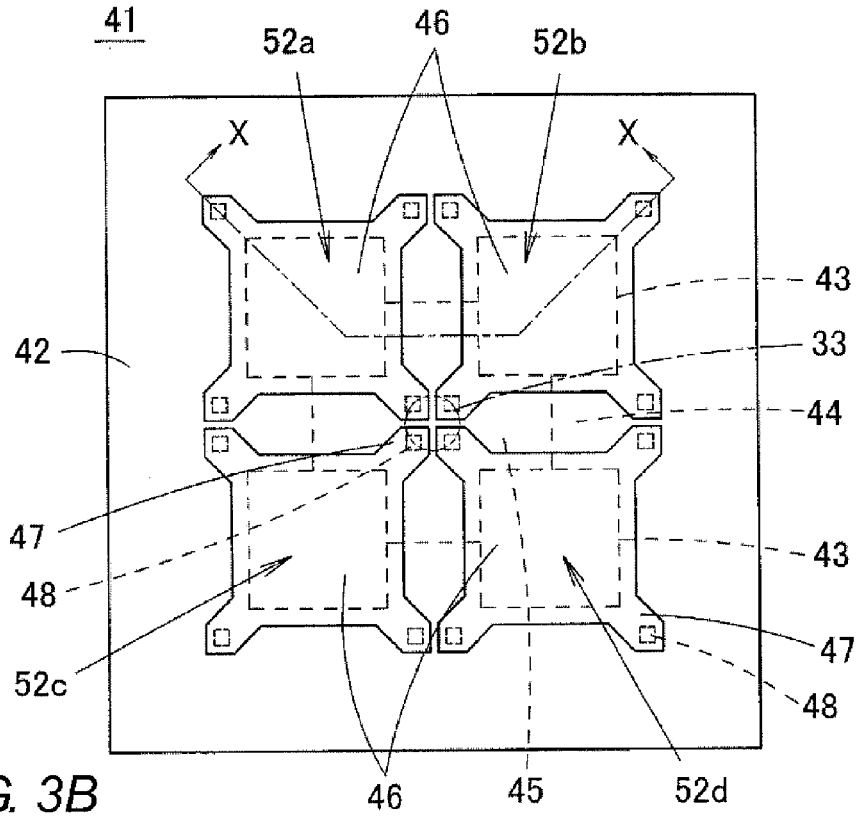
FIG. 3A is a partially-omitted plan view of an acoustic sensor of a first embodiment of the present invention.
Figure 3B:
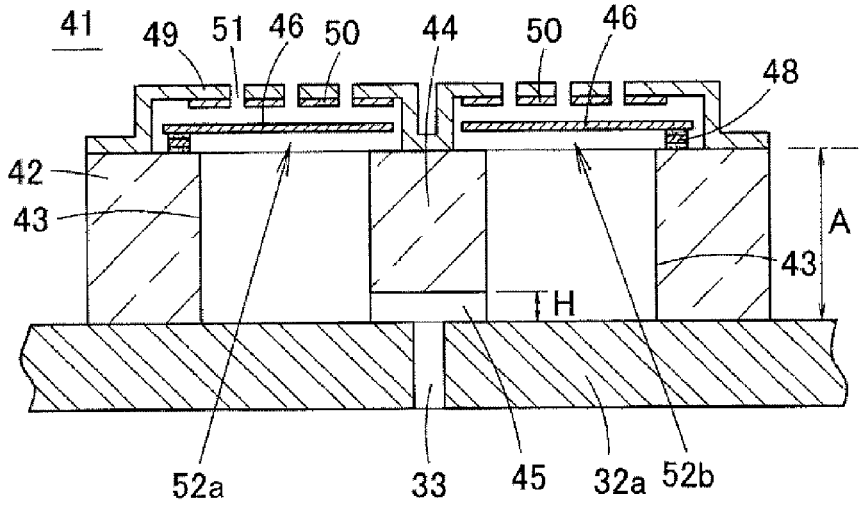
FIG. 3B is a cross section illustrating a state where the acoustic sensor of the first embodiment of the present invention is mounted on a package substrate.
Figure 4A:
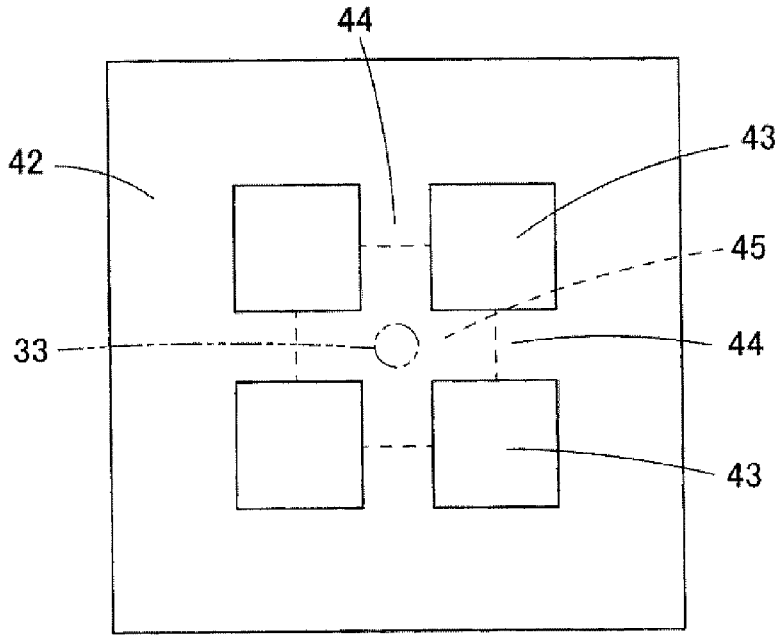
FIGS. 4A and 4B are a plan view and a perspective view of the back side of a substrate used for the acoustic sensor of FIG. 3A.
Figure 4B:
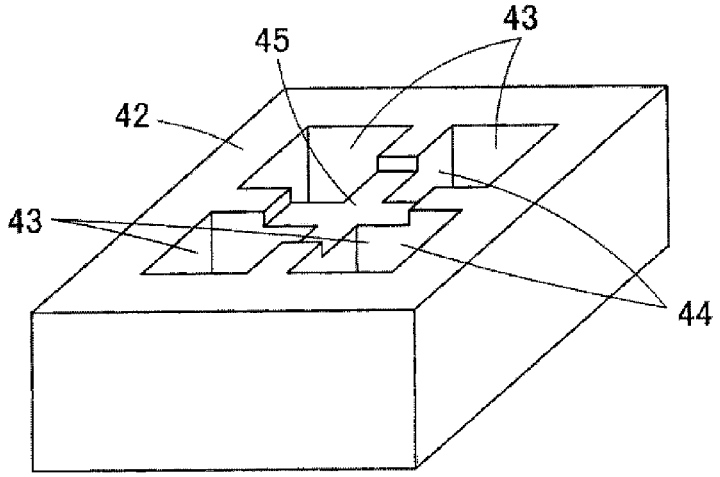
Figure 5:
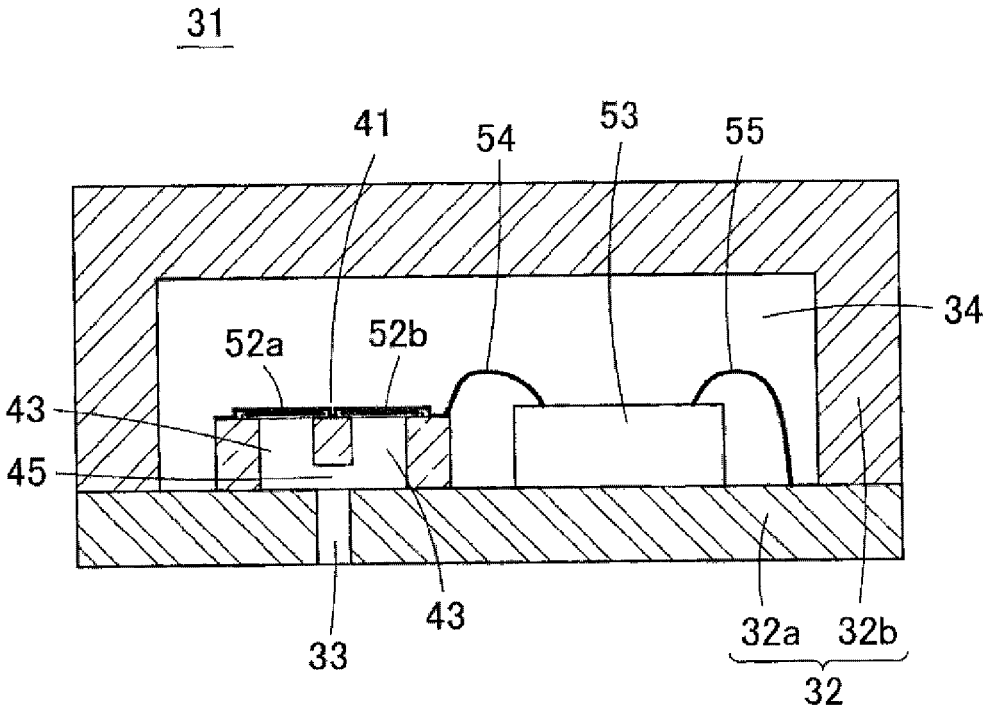
FIG. 5 is a cross section of a microphone incorporating the acoustic sensor of FIG. 3B.

Below, with reference to FIGS. 3A and 3B to FIG. 5, the structure of an acoustic sensor 41 and a microphone 31 according to a first embodiment of the present invention will be described. FIG. 3A is a plan view of the acoustic sensor 41 of the first embodiment of the invention. In FIG. 3A, a back plate 49 and a fixed electrode plate 50 of the acoustic sensor 41 are not illustrated. FIG. 3B is a cross section illustrating a state where the acoustic sensor 41 is mounted on a package substrate 32*a*. FIG. 3B is a cross section taken along line X-X of the acoustic sensor 41 of FIG. 3A and illustrates a cross section of the package substrate 32*a* through which a package sound hole 33 is provided. FIGS. 4A and 4B are a plan view and a perspective view from the back side, respectively, of a substrate 42 used for the acoustic sensor 41. FIG. 5 is a cross section of the microphone 31 incorporating the acoustic sensor 41.

As illustrated in FIGS. 3A and 3B, the acoustic sensor 41 is constructed by providing a plurality of sensing elements on the top surface of the semiconductor substrate 42 such as a silicon substrate. In the example illustrated, four sensing elements 52*a*, 52*b*, 52*c*, and 52*d* are provided. As illustrated in FIG. 4A, in the substrate 42, four prismatic-shaped cavities, that is, front chambers 43 are open so as to penetrate from the top surface to the bottom face. A partition wall 44 having a cross shape in plan view exists between the front chambers 43, and the front chambers 43 are separated from one another by the partition wall 44. Further, as illustrated in FIG. 4B, a part of the under surface of the partition wall 44 is dent upward, and a dent, that is, an acoustic space 45 is formed in the under surface of the partition wall 44. The height of the acoustic space 45 is equal to or less than the half of the height of the front chamber 43 (that is, the thickness of the substrate 42). In the first embodiment, the acoustic space 45 is provided on the side of the center (the intersection part of flat walls) more than the center of the flat wall positioned between the pair of front chambers 43, in the under surface of the partition wall 44, and the acoustic space 45 is dent in the cross shape in the under surface of the substrate 42. Therefore, the acoustic space 45 is communicated with the side faces of the lower end of each of the front chambers 43, and the front chambers 43 are also communicated with one another via the acoustic space 45.

Each of the sensing elements 52*a* to 52*d* of the acoustic sensor 41 is a capacitor structure mainly made by a conductive diaphragm 46 (movable electrode plate) and the fixed electrode plate 50 provided on the under surface of the back plate 49. The diaphragm 46 is a thin-film structure having an almost rectangular shape and is positioned above the top surface of the substrate 42 so as to cover the top surface of the front chamber 43. Supporting pieces 47 extend from the four corners of the diaphragm 46 in the opposing corner directions. Each of the supporting pieces 47 is supported by an anchor 48 provided on the top surface of the substrate 42. Therefore, the diaphragm 46 is apart from the top surface of the substrate 42, and there is a passage (vent hole) of acoustic oscillation between the periphery of the diaphragm 46 and the top surface of the substrate 42.

The back plate 49 made of an insulating material is provided above the diaphragm 46. The back plate 49 covers, like a dome, the diaphragm 46. The outer periphery and the portion located between the diaphragms of the back plate 49 are fixed to the top surface of the substrate 42. On the under surface of the back plate 49, the fixed electrode plate 50 having conductive property is provided so as to be opposed to the diaphragm 46 via an air gap. A number of small acoustic holes 51 are open in the back plate 49 and the fixed electrode plate 50 so as to penetrate the back plate 49 and the fixed electrode plate 50.

The microphone 31 (MEMS microphone) according to the first embodiment of the present invention incorporates the acoustic sensor 41 having the structure as described above. As illustrated in FIG. 5, a package 32 of the microphone 31 is made by the package substrate 32*a* and a cover 32*b*, and a package space 34 is formed on the inside of the package 32. As necessary, a wire and an electric circuit are provided for the top surface, the under surface, or the inside of the package substrate 32*a*, and the acoustic sensor 41 and a process circuit 53 such as an ASIC are mounted on the top surface of the package substrate 32*a*. The process circuit 53 is constructed by an amplification circuit, a power supply circuit, an output circuit, and the like. Further, the acoustic sensor 41 and the process circuit 53 are connected to each other via a bonding wire 54, and the process circuit 53 is connected to the wire and the electric circuit of the package substrate 32*a* via a bonding wire 55.

The package 32 is constructed by joining the under surface of the cover 32*b* to the top surface of the package substrate 32*a*, and the acoustic sensor 41 and the process circuit 53 are housed in the package space 34. As illustrated in FIG. 3B, the package sound hole 33 is open in the package substrate 32*a* in the position opposed to the center of the acoustic space 45. The package sound hole 33 vertically penetrates the package substrate 32*a*, and the opening in the top surface of the package sound hole 33 is communicated with the acoustic space 45. The package sound hole 33 may have any shape and, for example, may have an opening shape such as a circular, oval, or rectangular shape.

Therefore, in the microphone 31, the acoustic oscillation which enters the acoustic space 45 from the package sound hole 33 passes through the acoustic space 45, propagates to the front chambers 43, and oscillates the diaphragms 46 of the sensing elements 52*a* to 52*d*. As a result, in the sensing elements 52*a* to 52*d*, the acoustic oscillation is converted to the capacitance between the diaphragm 46 and the fixed electrode plate 50, and an electric signal is outputted to the process circuit 53.

Since the package sound hole 33 is directly connected to each of the front chambers 43 as described above, the acoustic oscillation which penetrates the acoustic sensor 41 from the package sound hole 33 passes through the acoustic space 45, enters the front chambers 43, and oscillates the diaphragm 46. The package space 34 in the package 32 (the outside of the acoustic sensor 41) serves as a back chamber. Therefore, the capacity of the back chamber in the microphone 31 can be enlarged, and the acoustic characteristics such as sensitivity and frequency characteristic of the microphone 31 can be improved.

Moreover, since the plurality of sensing elements 52*a* to 52*d* are provided, sensitivity can be improved by adding outputs of the sensing elements 52*a* to 52*d* in the process circuit 53 or the sensitivity, frequency band, sound pressure band, or the like can be widened by switching outputs of the sensing elements 52*a* to 52*d*.

Since the sensing elements 52*a* to 52*d* are manufactured on the same substrate by using the MEMS manufacturing technique, the manufacture variations in the sensing elements 52*a* to 52*d* can be reduced. Further, since one package sound hole 33 is directly connected to each of the front chambers 43 by the acoustic space 45, the acoustic oscillation which entered from the same package sound hole 33 is transmitted to the sensing elements 52*a* to 52*d*, and the same acoustic oscillation can be detected by the sensing elements 52*a* to 52*d*.

Further, in the microphone 31 or the acoustic sensor 41 of the first embodiment, the front chambers 43 are partitioned by the partition walls 44, and the partition wall 44 is provided in the region of the half or more of the height of the front chamber 43, so that the rigidity of the substrate 42 can be increased by the partition walls 44. Consequently, even when an impact is applied to the acoustic sensor 41 due to drop of a device in which the microphone 31 is assembled or the like, the diaphragm 46 can be prevented from being excessively deformed, so that the diaphragm 46 is not easily damaged by an impact.

Figure 1:
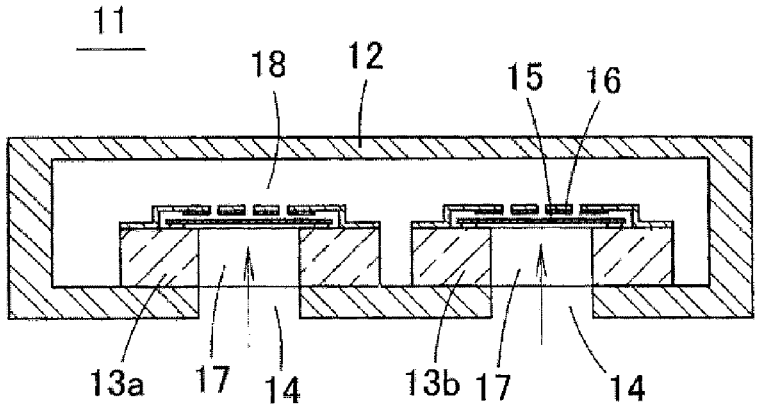
FIG. 1 is a cross section illustrating a structure of a microphone as a reference example incorporating a plurality of acoustic sensors.
Figure 2:
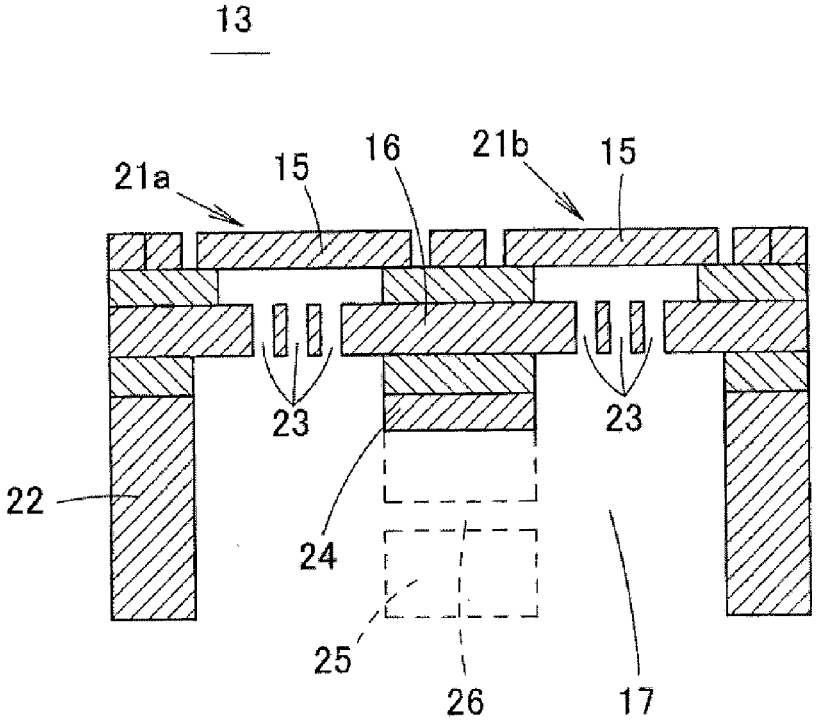
FIG. 2 is a cross section of an acoustic sensor described in U.S. Unexamined Patent Application Publication No. 2007-47746.

Since the etching volume of the substrate 42 in the acoustic sensor 41 of the first embodiment is smaller than that in the acoustic sensor illustrated in FIG. 2, the etching time in the manufacturing process of the acoustic sensor 41 can be shortened, and the productivity of the acoustic sensor 41 improves.

In the acoustic sensor 41 of the first embodiment, the front chambers 43 are partitioned by the partition wall 44, so that the acoustic oscillation which enters from the package sound hole 33 into the front chambers 43 does not easily escape, and the low-frequency characteristic of the acoustic sensor 41 becomes excellent.

In the microphone 31 of the first embodiment, the under surface of the partition wall 44 is opposed to the package sound hole 33, so that the microphone 31 is resistant to disturbance which intrudes from the package sound hole 33, and the functions of the microphone 31 do not easily deteriorate. That is, not only a foreign matter such as dust or liquid but also a factor which gives a damage such as compressed air or excessive sound pressure does not easily penetrate from the package sound hole 33 to the inside of the acoustic sensor 41, so that resistance to disturbance of the acoustic sensor 41 can be increased. In particular, for this purpose, according to one or more embodiments of the present invention, the diameter of the package sound hole 33 is set to be smaller than the thickness of the partition wall 44, and the package sound hole 33 is provided so as not to overlap the front chamber 43 when viewed from above.

Further, since the acoustic space 45 is provided below the substrate 42, the size of the package sound hole 33 can be made small, and alignment at the time of mounting the acoustic sensor 41 to the package 32 becomes easy.

The position of the package sound hole 33 is not limited to the center of the acoustic space 45. When the package sound hole 33 is in the position opposed to the under surface of the partition wall 44, intrusion of disturbance can be prevented. If the intrusion of disturbance is not an issue as will be described later, the package sound hole 33 may be in a position opposed to the front chamber 43. Consequently, by making the package sound hole 33 small, alignment to the package sound hole 33 at the time of mounting the acoustic sensor 41 to the package 32 is facilitated.

Manufacturing Method 1

Figure 6A:
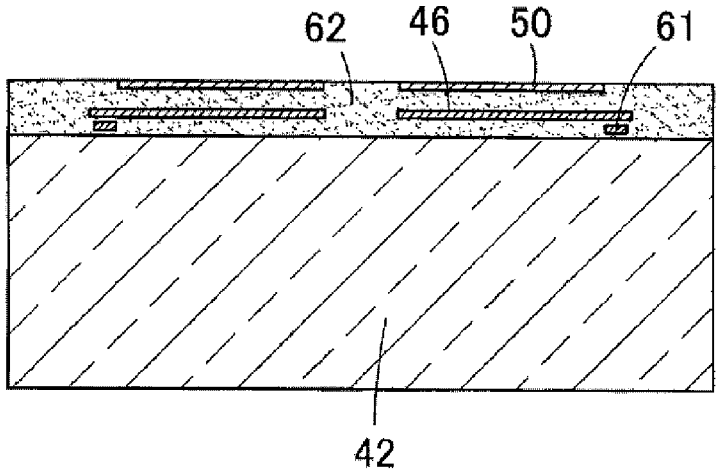
FIGS. 6A to 6C are cross sections for explaining a first manufacturing method for manufacturing the acoustic sensor of FIG. 3B.
Figure 6B:
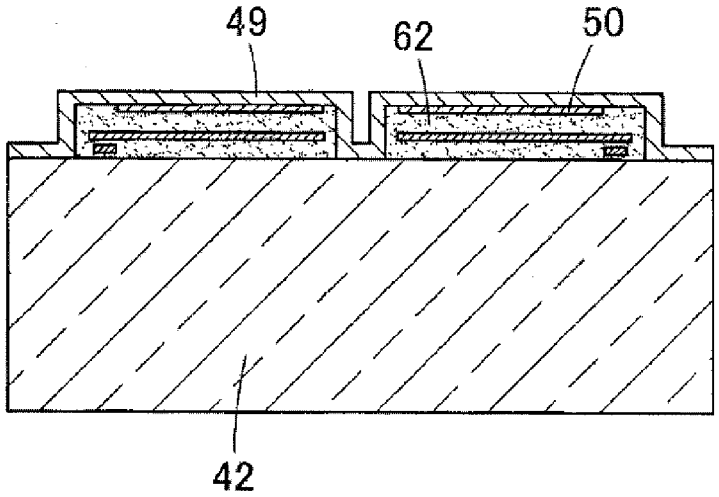
Figure 6C:
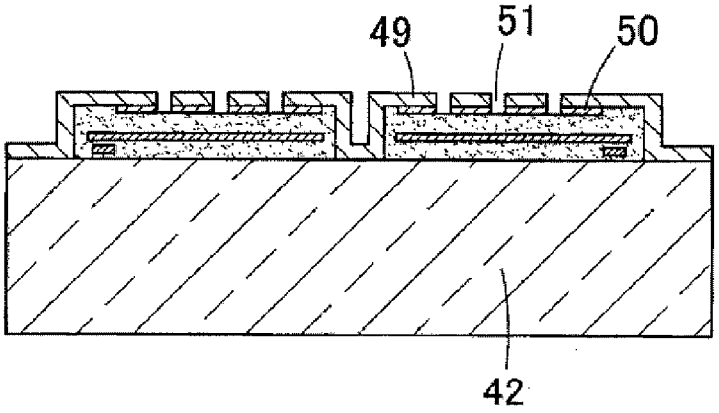

Next, a manufacturing process for manufacturing the acoustic sensor 41 of the first embodiment will be described with reference to FIGS. 6A to 6C to FIGS. 9A to 9C. FIG. 6A illustrates a state where an $SiO_2$ layer 62 (sacrifice layer) and a plurality of polysilicon layers are stacked on the top surface of the silicon substrate 42 (substrate material such as Si wafer) by using a film forming technique such as CVD. The polysilicon layers are patterned. An anchor layer 61 is formed in a position where the anchor 48 is provided, the layer upper than the anchor layer 61 is patterned so as to become the diaphragm 46, and the layer upper than the diaphragm 46 is patterned so as to become the fixed electrode plate 50. In the process illustrated in FIG. 6B, the $SiO_2$ layer 62 is etched so as to have the inner-face shape of the back plate 49, and an SiN film is formed on the surface of the $SiO_2$ layer 62, thereby manufacturing the back plate 49. In the process illustrated in FIG. 6C, the back plate 49 and the fixed electrode plate 50 are sequentially etched to open a number of acoustic holes 51 penetrating the back plate 49 and the fixed electrode plate 50. After that, the rear face of the silicon substrate 42 is polished to reduce the substrate thickness, for example, from 725 μm to 400 μm.

Figure 7A:
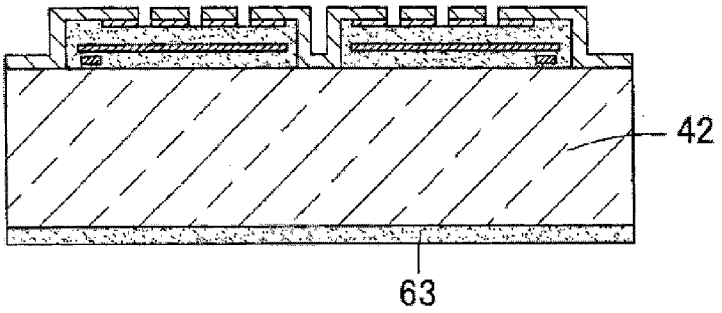
FIGS. 7A to 7C are cross sections for explaining the first manufacturing method for manufacturing the acoustic sensor of FIG. 3B, which are continuation diagrams of FIG. 6C.
Figure 7B:
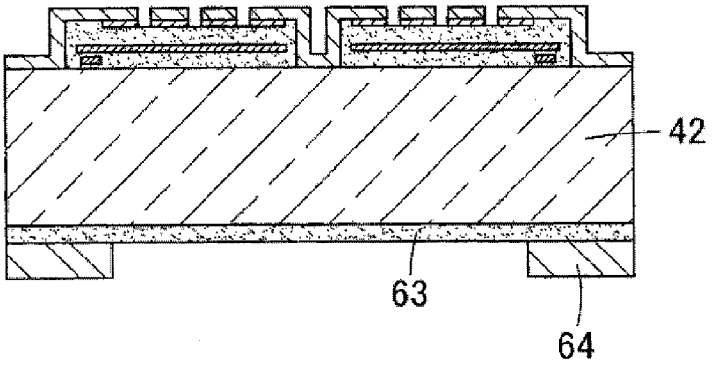
Figure 7C:
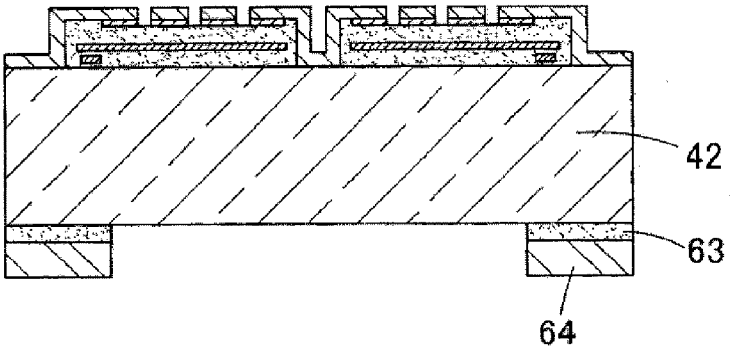

After that, as illustrated in FIG. 7A, an $SiO_2$ layer 63 (first mask) is formed on the entire rear face of the substrate 42. In the process of FIG. 7B, a photoresist 64 is formed on the under surface of the $SiO_2$ layer 63. Subsequently, the photoresist 64 is patterned by photolithography so as to be open in the under surface of the region which will become the front chambers 43 and the acoustic space 45. In the process of FIG. 7C, the exposed part of the $SiO_2$ layer 63 is removed by etching through the opening of the photoresist 64. As a result, the $SiO_2$ layer 63 becomes an $SiO_2$ hard mask which opens in the under surface of the region which will become the front chambers 43 and the acoustic space 45.

Figure 8A:
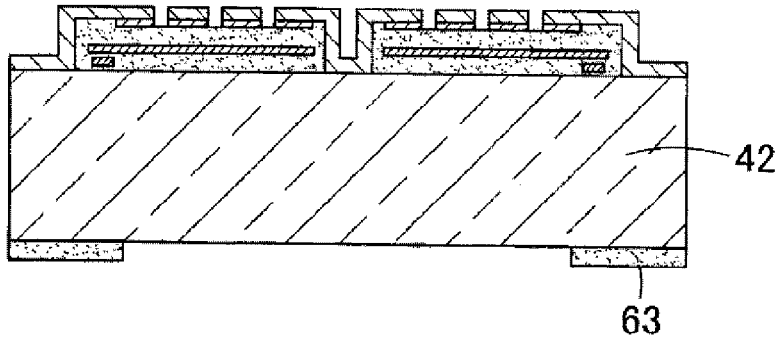
FIGS. 8A to 8C are cross sections for explaining the first manufacturing method for manufacturing the acoustic sensor of FIG. 3B, which are continuation diagrams of FIG. 7C.
Figure 8B:
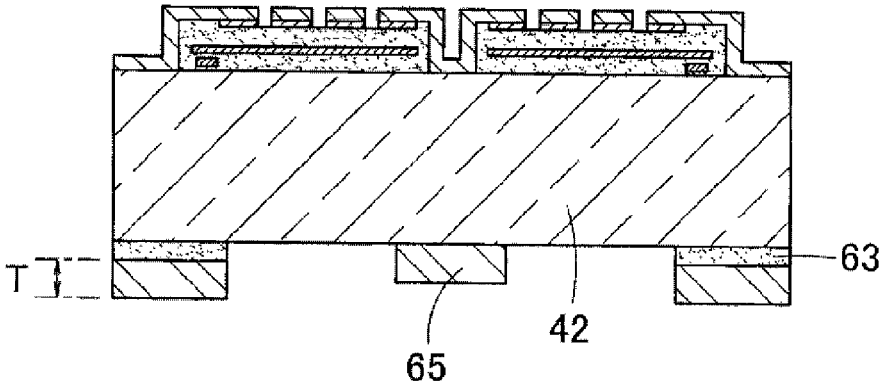

After removing the photoresist 64 as illustrated in FIG. 8A, a photoresist 65 is applied again on the entire under surface of the substrate 42 and the $SiO_2$ layer 63. The photoresist 65 is subsequently patterned by photolithography so as to be open in the under surface of the regions which will become the front chambers 43 as illustrated in FIG. 8B. In the region where the $SiO_2$ layer 63 exists, the photoresist 65 may not exist.

Figure 8C:
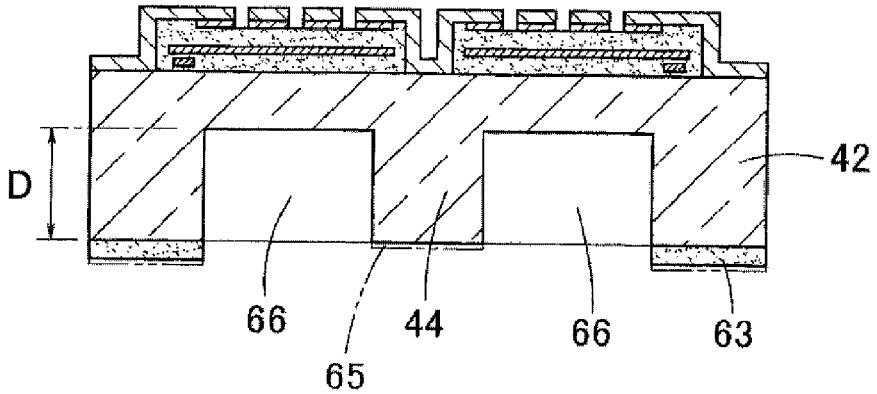

After that, using the photoresist 65 as a second mask, the rear face of the substrate 42 is dry-etched. The dry etching progresses at a high etching rate in the exposed part of the substrate 42. On the other hand, since the etching rate of the photoresist 65 is much lower than that of the substrate 42, exhaustion of the photoresist 65 by dry etching is very small. As a result, as illustrated in FIG. 8C, in the regions which become the front chambers 43 in the under surface of the substrate 42, recesses 66 having a depth equal to A-H are formed. Here, "A" denotes thickness of the (polished) substrate 42, and "H" indicates height of the acoustic space 45 (refer to FIG. 3B).

Figure 9A:
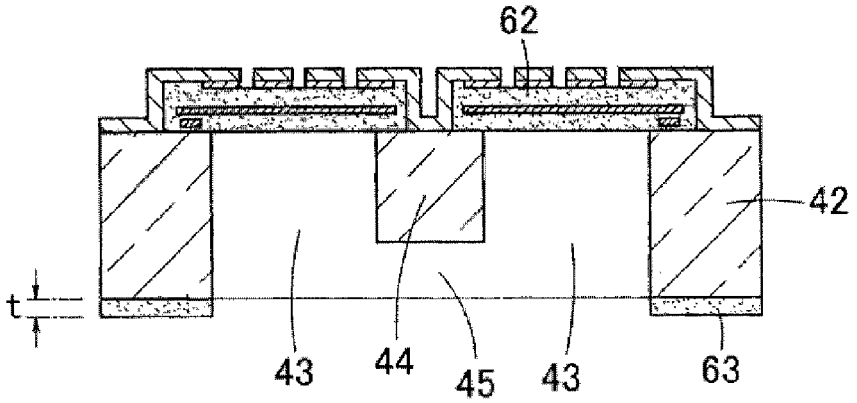
FIGS. 9A to 9C are cross sections for explaining the first manufacturing method for manufacturing the acoustic sensor of FIG. 3B, which are continuation diagrams of FIG. 8C.

Subsequently, as illustrated in FIG. 9A, using the $SiO_2$ layer 63 as a first mask, the rear side of the substrate 42 is dry-etched. As a result, the front chambers 43 penetrate the substrate 42 in the regions where the recesses 66 existed, the acoustic space 45 is formed below the under surface of the substrate 42, in the region where the photoresist 65 was provided directly on the under surface of the substrate 42, and the partition wall 44 is formed by the remained part which is not etched.

Thickness "t" of the $SiO_2$ layer 63 has to be thickness resistive to the substrate etching in the process of FIG. 9A after the photoresist 65 does not exist. That is, the etching of the front chamber parts has to reach the top surface of the substrate 42 before the $SiO_2$ layer 63 is exhausted by the etching. For the purpose, the thickness "t" of the $SiO_2$ layer 63 has to satisfy t H×(etching rate ratio of the $SiO_2$ layer to the substrate). Here, H denotes height of the acoustic space 45. For example, when it is assumed that the height H of the acoustic space 45 is 20 μm and the etching rate of the $SiO_2$ layer 63 is 1/250 time of the etching rate of the substrate 42, it is sufficient to set the thickness "t" of the $SiO_2$ layer 63 equal to or larger than $H\times(1/250)=20/250=0.08$ [μm]. Particularly, if the thickness "t" is set to be equal to 0.08 μm, at the time when the etching of the front chambers 43 reaches the top surface of the substrate 42 and the opening of the front chambers 43 is finished, there is no $SiO_2$ layer 63. Therefore, it becomes unnecessary to remove the $SiO_2$ layer 63 after the etching of the front chamber 43.

According to one or more embodiments of the present invention, the thickness "T" of the photoresist 65 manufactured in the process of FIG. 8B is set to (A−H)×(etching rate ratio of the photoresist to the substrate) (where A denotes thickness of the substrate 42 and H denotes height of the acoustic space 45). For example, when it is assumed that the thickness A of the substrate 42 is 400 μm, the height H of the acoustic space 45 is 20 μm and the etching rate of the photoresist 65 is 1/80 time of that of the substrate 42, it is sufficient to set the thickness "T" of the photoresist 65 as $T=(A-H)\times(1/80)=(400-20)/80=4.75$[μm]. By preparing the thickness T of the photoresist 65 as described above, at the time when all of the photoresist 65 is etched and the $SiO_2$ layer 63 and the substrate 42 are exposed, the depth D of the recess 66 in the substrate 42 becomes equal to A–H. When the dry etching is continued, the substrate 42 is etched using the $SiO_2$ layer 63 as the first mask, and the region in which the photoresist 65 is directly provided in the substrate 42 (the region which will become the acoustic space 45) and the top surface of the recess 66 (the region which will become the front chamber 43) are etched. The process after all of the photoresist 65 is etched is the process of FIG. 9A. Therefore, by preparing the thickness T of the photoresist 65 as described above, without taking the substrate 42 out from a dry etching device, the process of FIG. 8C and the process of FIG. 9A can be continuously performed. Therefore, the time for the substrate etching process is shortened, and the productivity of the acoustic sensor improves.

As illustrated by the alternate long and two short dashes line in FIG. 8C, the dry etching in the process of FIG. 8C may be temporarily finished in a state where the photoresist 65 remains slightly. The remaining photoresist 65 is removed by ashing. After that, in the process of FIG. 9A, the dry etching is performed again to penetrate the front chambers 43 to the top surface of the substrate 42 and provide the acoustic space 45. Also by such a method, without taking the substrate 42 from the dry etching device, the process of FIG. 8C and the process of FIG. 9A can be performed continuously.

Moreover, in the method of completely removing the photoresist 65 by dry etching, the height of the acoustic space 45 varies due to variations in the thickness of the photoresist 65 and variations at the time of dry etching. On the other hand, when the photoresist 65 which remains slightly is removed by ashing, the height of the acoustic space 45 is not influenced by the variations in the thickness of the photoresist 65. As a result, the height of the acoustic space 45 is influenced only by variations at the time of dry etching, and the height precision of the acoustic space 45 improves.

Figure 9B:
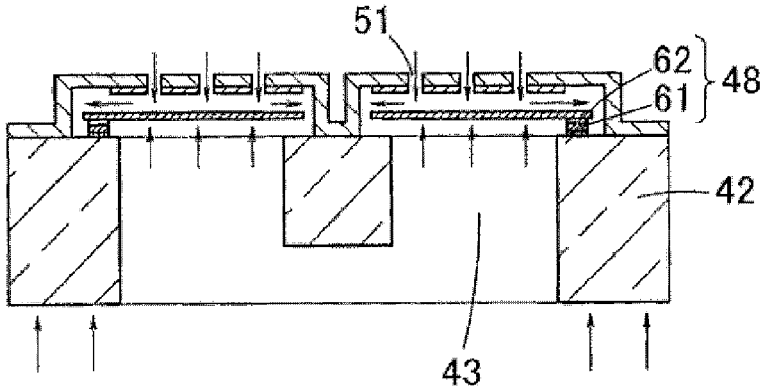
Figure 9C:
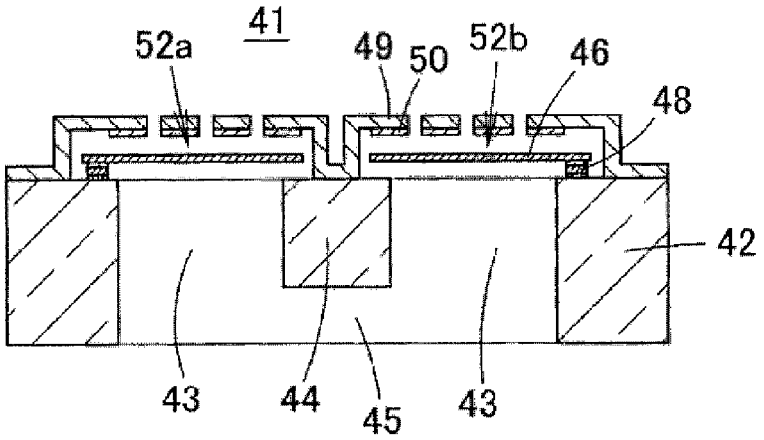

In the process of FIG. 9B, an etchant of BHF or the like is applied to the top surface and the under surface of the silicon substrate 42. The etchant penetrates the back plate 49 from the acoustic holes 51 and the front chambers 43 and removes the $SiO_2$ layer 62 by etching. The etching is stopped at a stage where the $SiO_2$ layer 62 remains on the top surface and the under surface of the anchor layer 61, and the substrate 42 is washed. The $SiO_2$ layer 63 on the under surface of the substrate 42 is also removed by this process.

As illustrated in FIG. 9B, the anchor 48 is formed by the anchor layer 61 and the $SiO_2$ layer 62 on the upper and lower sides of the anchor layer 61, the four corners of each of the diaphragms 46 are supported by the anchors 48, and a gap is formed between the diaphragm 46 and the fixed electrode plate 50.

According to the first manufacturing method as described above, by determining the thickness of the photoresist 65 in accordance with the ratio of the etching rate of the photoresist 65 to the etching rate of the substrate 42, etching of the front chamber 43 and the etching of the acoustic space 45 can be performed by a single dry-etching process, so that the efficiency of the manufacturing process of the acoustic sensor 41 can be increased. By determining the thickness of the $SiO_2$ layer 63 in accordance with the ratio of the etching rate of the $SiO_2$ layer 63 to the etching rate of the substrate 42, the $SiO_2$ layer 63 can be eliminated at the time point when the front chambers 43 are formed. The process of eliminating the $SiO_2$ layer 63 becomes unnecessary after the process of forming the front chambers 43, and the efficiency of the process of manufacturing the acoustic sensor 41 can be increased.

Second Manufacturing Method

Figure 10A:
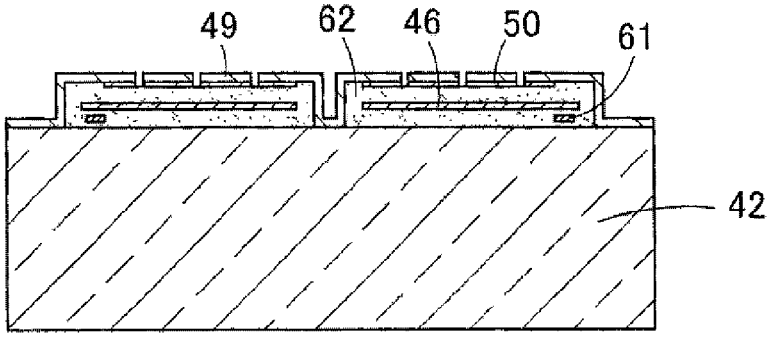
FIGS. 10A to 10C are cross sections for explaining a second manufacturing method for manufacturing the acoustic sensor of FIG. 3B.
Figure 10B:
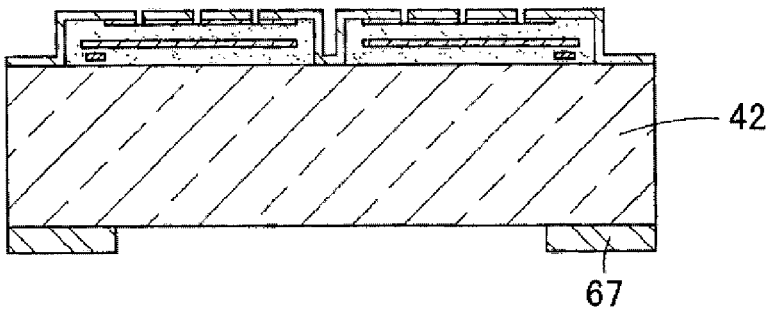
Figure 10C:
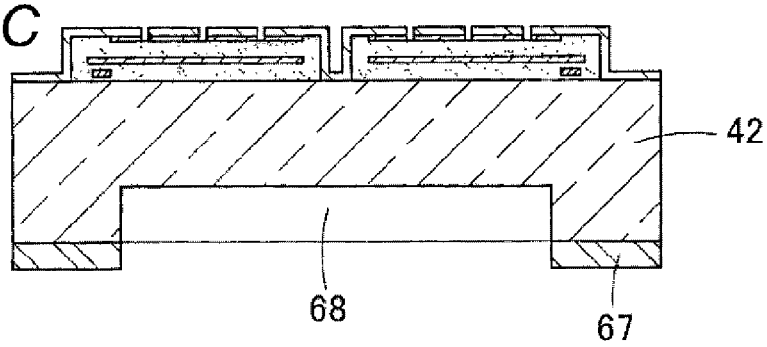
Figure 11A:
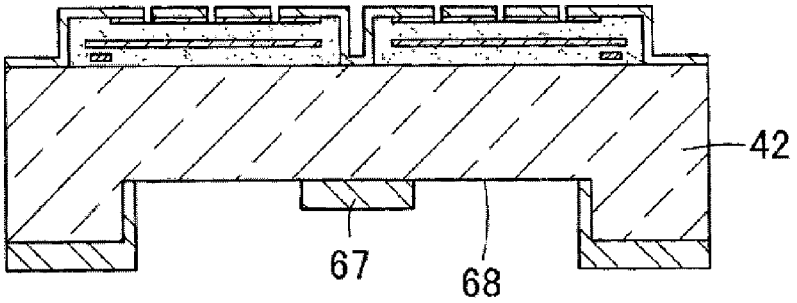
FIGS. 11A to 11C are cross sections for explaining the second manufacturing method for manufacturing the acoustic sensor of FIG. 3B, which are continuation diagrams of FIG. 10C.

The acoustic sensor 41 can be manufactured by a method other than the above-described manufacturing method. Another manufacturing process for manufacturing the acoustic sensor 41 will be described with reference to FIGS. 10A to 10C and FIGS. 11A to 11C. In FIG. 10A, by a process similar to that of FIGS. 6A to 6C, the anchor layer 61, the $SiO_2$ layer 62, the diaphragm 46, the back plate 49, and the fixed electrode plate 50 are formed on the top surface of the silicon substrate 42 (Si wafer). The rear face of the substrate 42 is polished to reduce the thickness of the substrate 42, for example, from 725 μm to 400 μm. After that, as illustrated in FIG. 10B, a photoresist 67 is formed on the under surface of the substrate 42 and is patterned by photolithography, thereby forming an opening in the photoresist 67 in a region which will become the front chambers 43 and the acoustic space 45. In the process of FIG. 10C, using the photoresist 67 as a third mask, the under surface of the substrate 42 is dry-etched. By the etching time management (for example, DRIE time fixation), a recess 68 having a depth equal to height H (for example, 20 μm) of the acoustic space 45 is formed below the under surface of the substrate 42. After that, a photoresist is applied again by a spray coater to form the photoresist 67 also on the top surface and side wall faces of the recess 68. As illustrated in FIG. 11A, the photoresist 67 is patterned to form an opening in the photoresist 67 in regions which will become the front chambers 43. At this time, according to one or more embodiments of the present invention, the amount of the photoresist 67 projected to the recess 68 is set to a degree that the photoresist 67 is etched backward to the rear face of the substrate 42 in the process of etching in FIG. 11B.

Figure 11B:
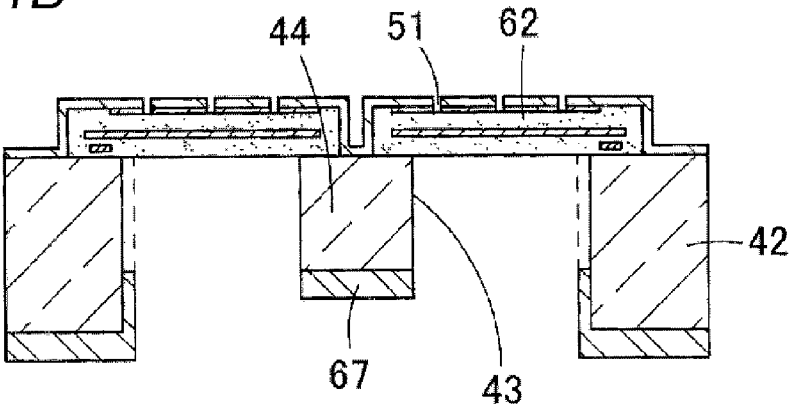

As illustrated in FIG. 11B, using the photoresist 67 as a fourth mask, the substrate 42 is dry-etched from the under surface side to make the front chambers 43 penetrate in the substrate 42. Since the part which becomes the acoustic space 45 is covered with the photoresist 67 at this time, the depth is not further increased. In the process, there is the possibility that steps are formed in the side wall faces of the front chamber 43 as shown by broken lines in FIG. 11B due to the photoresist 67 formed on the side wall faces of the recess 68. However, when the photoresist 67 on the side wall faces is etched backward to the rear face of the substrate 42 as the dry etching progresses, the steps in the side wall faces of the front chambers 43 become inconspicuous. When such steps are not a problem (there is hardly any influence on the functions of the acoustic sensor), the amount of the photoresist 67 projecting to the recess 68 may not be optimized.

In the description, the same reference numeral (67) is used for the photoresist as the third mask and the photoresist as the fourth mask to suggest that the photoresists are of the same material. However, the photoresist as the third mask and the photoresist as the fourth mask may be of different photoresist materials. Although the fourth mask is formed by applying the photoresist 67 in a state where the third mask remains in the above description, after the third mask is removed, the fourth mask may be newly formed by applying the photoresist 67. In the process of FIG. 11A, without forming the photoresist 67 on the side wall faces of the recess 68, the side wall faces of the recess 68 may be exposed from the photoresist 67.

Figure 11C:
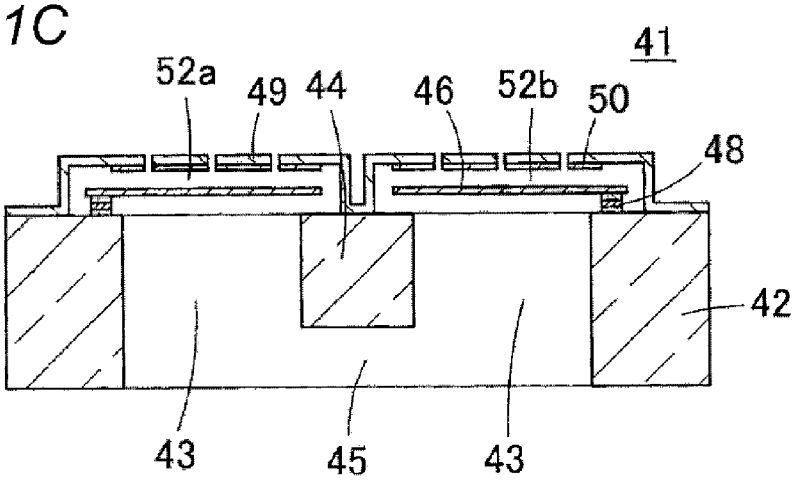

After that, an etchant such as BHF is applied to the top surface and the under surface of the silicon substrate 42, the $SiO_2$ layer 62 is removed except for the $SiO_2$ layer 62 on/below the anchor layer 61, and the photoresist 67 on the under surface of the substrate 42 is removed by etching, thereby obtaining the acoustic sensor 41 as illustrated in FIG. 11C.

Third Manufacturing Method

Figure 12A:
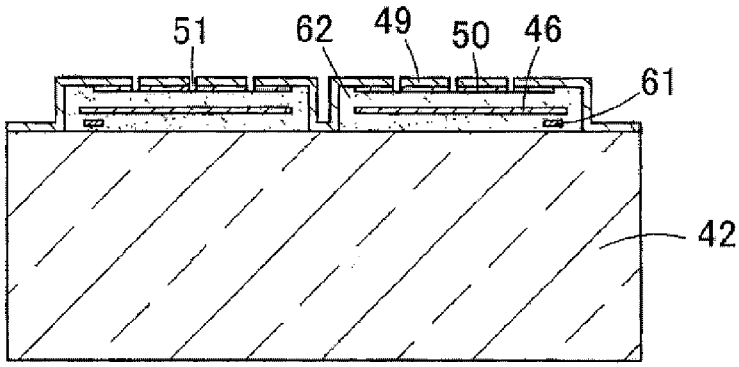
FIGS. 12A to 12C are cross sections for explaining the second manufacturing method for manufacturing the acoustic sensor of FIG. 3B, which are continuation diagrams of FIG. 11C.
Figure 12B:
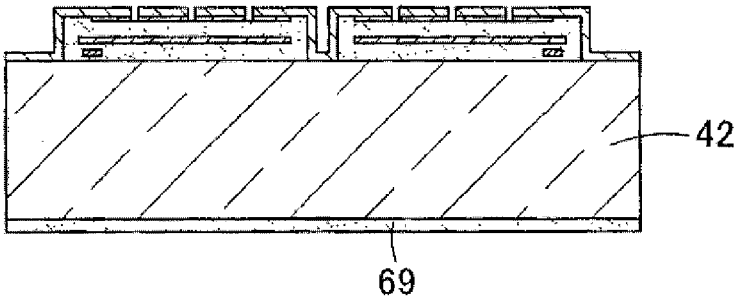

Further another manufacturing process for manufacturing the acoustic sensor 41 will be described with reference to FIGS. 12A to 12C to FIGS. 14A and 14B. In FIG. 12A, the anchor layer 61, the $SiO_2$ layer 62, the diaphragm 46, the back plate 49, and the fixed electrode plate 50 are formed on the top surface of the silicon substrate 42 (Si wafer). The rear face of the substrate 42 is polished to reduce the thickness of the substrate 42, for example, from 725 μm to 400 μm. After that, as illustrated in FIG. 12B, a P—$SiO_2$ film 69 (for example, the film thickness thereof is 10,000 Å) is formed as a first mask on the under surface of the substrate 42.

Figure 12C:
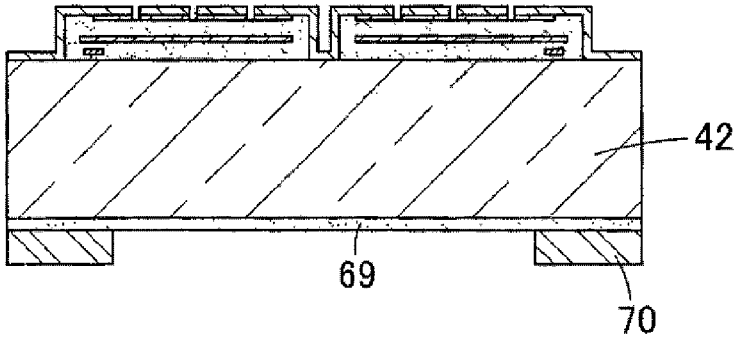
Figure 13A:
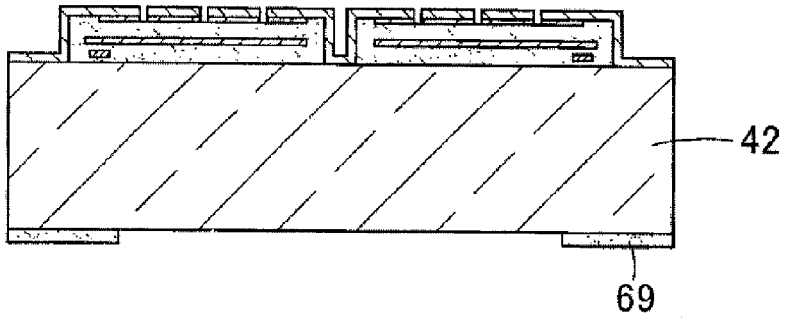
FIGS. 13A to 13C are cross sections for explaining the second manufacturing method for manufacturing the acoustic sensor of FIG. 3B, which are continuation diagrams of FIG. 12C.

After that, in the process of FIG. 12C, a photoresist 70 is applied on the entire under surface of the P—$SiO_2$ film 69 and is patterned by photolithography, thereby forming an opening in the photoresist 70 in the under surface of a region which will become the front chambers 43 and the acoustic space 45. Subsequently, as illustrated in FIG. 13A, an etchant of BHF or the like is applied to the exposed parts in the P—$SiO_2$ film 69 via the opening in the photoresist 70 to selectively etch the exposed parts in the P—$SiO_2$ film 69. As a result, the P—$SiO_2$ film 69 is formed in the opening in the under surface of the region which becomes the front chambers 43 and the acoustic space 45. After that, the photoresist 70 is peeled off.

Figure 13B:
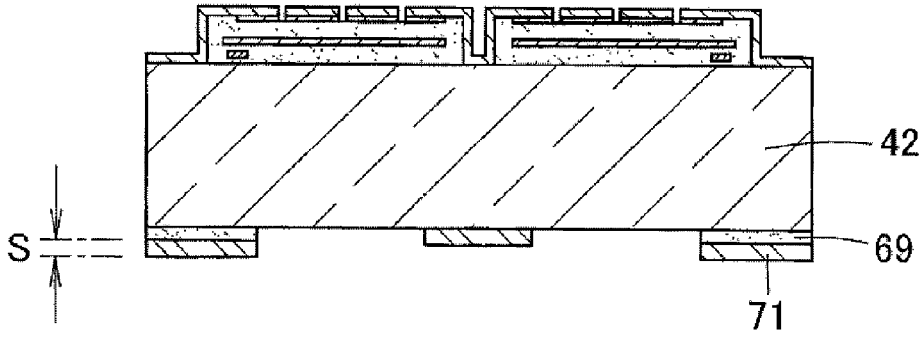
Figure 13C:
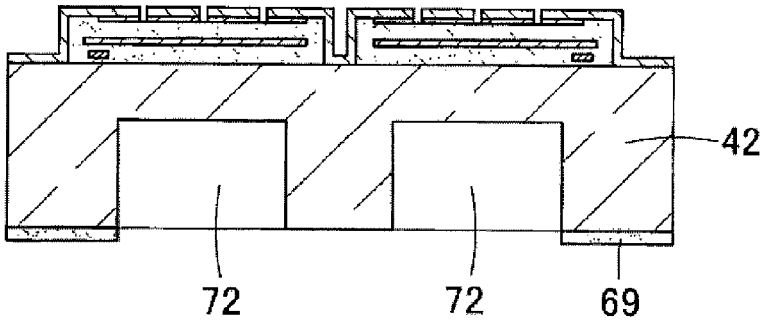
Figure 14A:
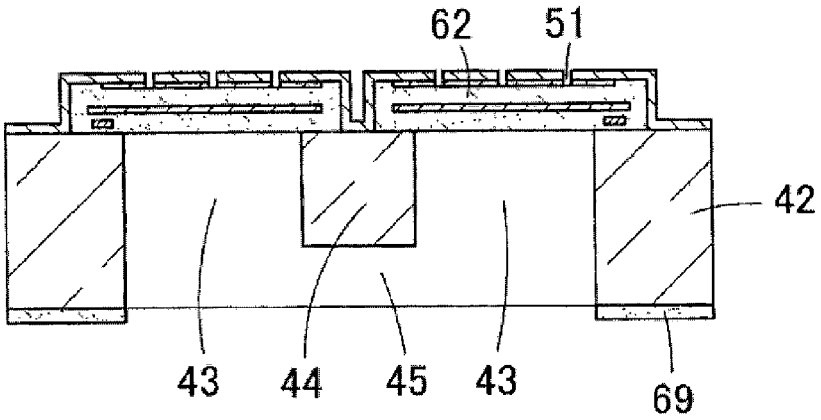
FIGS. 14A and 14B are cross sections for explaining the second manufacturing method for manufacturing the acoustic sensor of FIG. 3B, which are continuation diagrams of FIG. 13C.

In the process of FIG. 13B, a photoresist 71 is applied again to the entire under surface of the substrate 42 and the P—$SiO_2$ film 69. Subsequently, the photoresist 71 is patterned by photolithography to form openings in the photoresist 71 in the under surface of the regions which become the front chambers 43. The thickness S of the photoresist 71 as the second mask is expressed as S=(A−H)×(etching rate ratio of the photoresist to the substrate) where A denotes thickness of the substrate 42 and H denotes the height of the acoustic space 45. For example, when it is assumed that the thickness A of the substrate 42 is 400 μm, the height H of the acoustic space 45 is 20 and the etching rate of the photoresist 71 is 1/80 time of the etching rate of the substrate 42, it is sufficient to set the thickness S of the photoresist 65 as S=(A−H)×(1/80)=(400−20)/80=4.75 [μm]. By adjusting the thickness S of the photoresist 71 as described above, when all of the photoresist 71 is dry-etched as illustrated in FIG. 13C, recesses 72 having a depth of A-H are formed in the regions which become the front chambers 43 in the substrate 42. Further, if the dry etching is continued, since the etching rate of the P—$SiO_2$ film 69 is 1/250 to 1/300 of the etching rate of the substrate 42, the P—$SiO_2$ film 69 is hardly etched. Consequently, as illustrated in FIG. 14A, when the dry etching is performed until the recess 72 reaches the top surface of the substrate 42, the acoustic space 45 having the height H is formed below the under surface of the partition wall 44. Therefore, also by the manufacturing method, without taking the substrate 42 out from the dry etching device, the process of FIG. 13C and the process of FIG. 14A can be continuously performed, the time of the substrate etching process is shortened, and the productivity of the acoustic sensor improves. Since the P—$SiO_2$ film 69 having low etching rate is used as the first mask, the thickness of the P—$SiO_2$ film 69 can be made small, the film formation time of the first mask (P—$SiO_2$ film 69) can be shortened, and the productivity of the acoustic sensor improves.

Figure 14B:
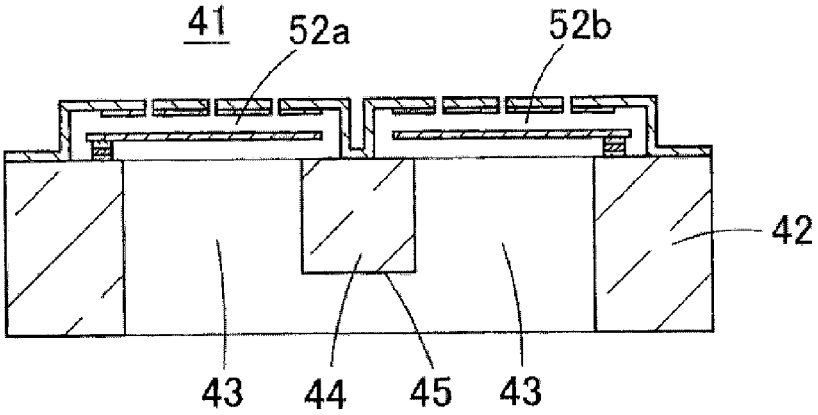

After that, an etchant of BHF or the like is applied to the top surface and the under surface of the silicon substrate 42, the $SiO_2$ layer 62 is removed except for the $SiO_2$ layer 62 on/below the anchor layer 61, and the P—$SiO_2$ film 69 on the under surface of the substrate 42 is removed, thereby obtaining the acoustic sensor 41 as illustrated in FIG. 14B.

Also by the third manufacturing method, like the first manufacturing method, the efficiency of the manufacturing process of the acoustic sensor 41 can be increased, and the productivity of the acoustic sensor 41 can be improved.

Modification of First Embodiment

Figure 15A:
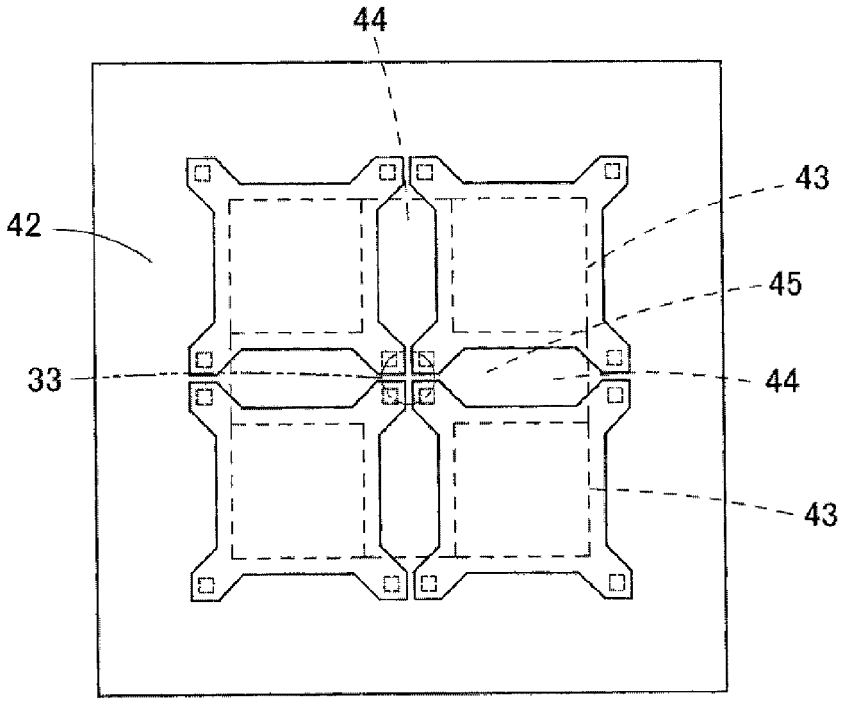
FIG. 15A is a partially-omitted plan view of an acoustic sensor according to a modification of the first embodiment of the present invention.
Figure 15B:
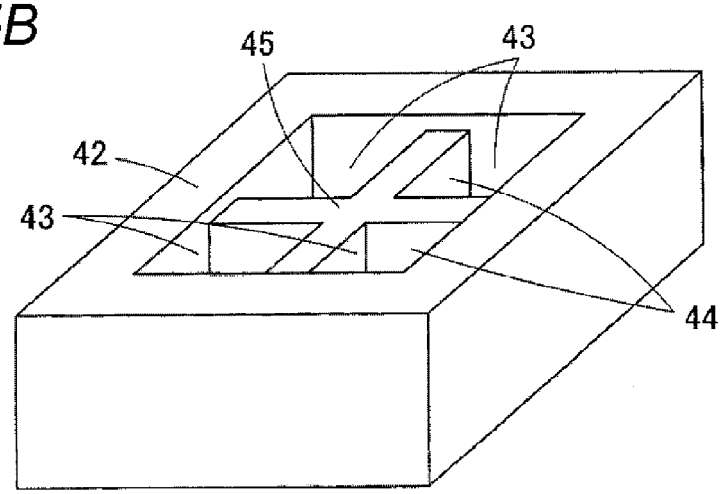
FIG. 15B is a perspective view from the back side of a substrate used for the acoustic sensor of FIG. 15A.

In the first embodiment, the shape and layout of the partition wall 44, the acoustic space 45, the front chamber 43, and the like can be freely changed. For example, in a modification illustrated in FIGS. 15A and 15B, the acoustic space 45 is formed on the entire under surface of the partition walls 44.

Figure 16:
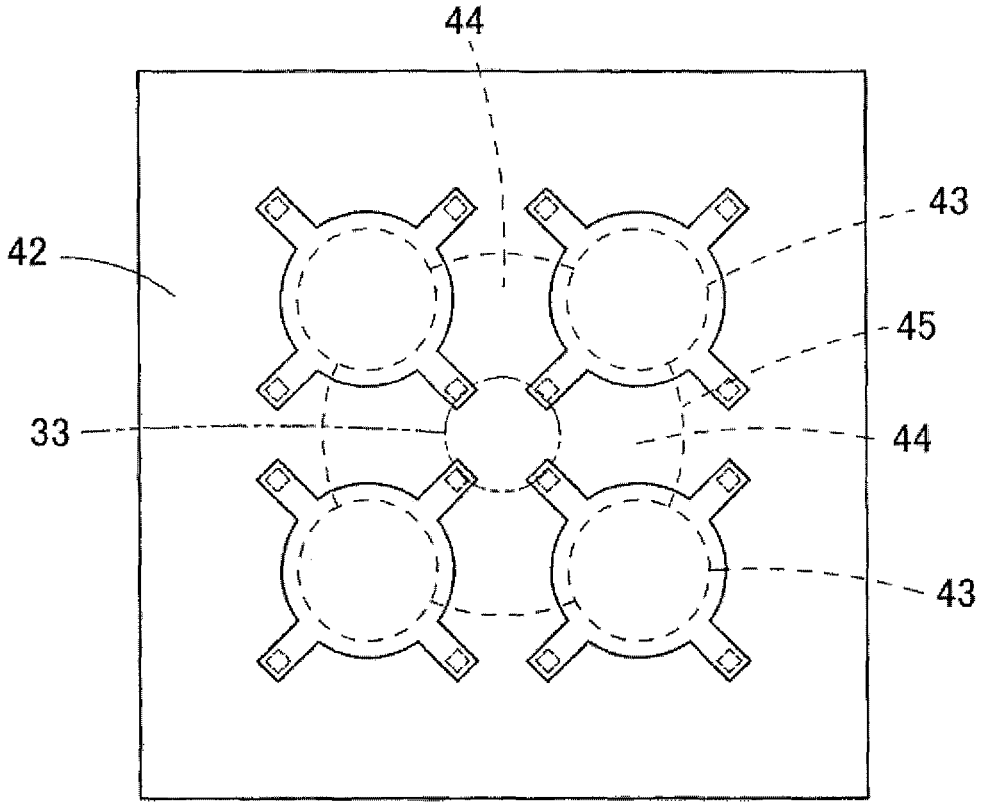
FIG. 16 is a partially-omitted plan view of an acoustic sensor according to another modification of the first embodiment of the present invention.

In another modification illustrated in FIG. 16, the front chambers 43 having a columnar shape is provided for the substrate 42, and the acoustic space 45 having an almost cross shape is provided so as to be recessed below the under surface of the partition wall 44. In plan view, the acoustic space 45 has an almost cross shape obtained by eliminating the portions of the front chambers 43 from the circular region using the center of the partition walls 44 as a center.

Second Embodiment

Figure 17A:
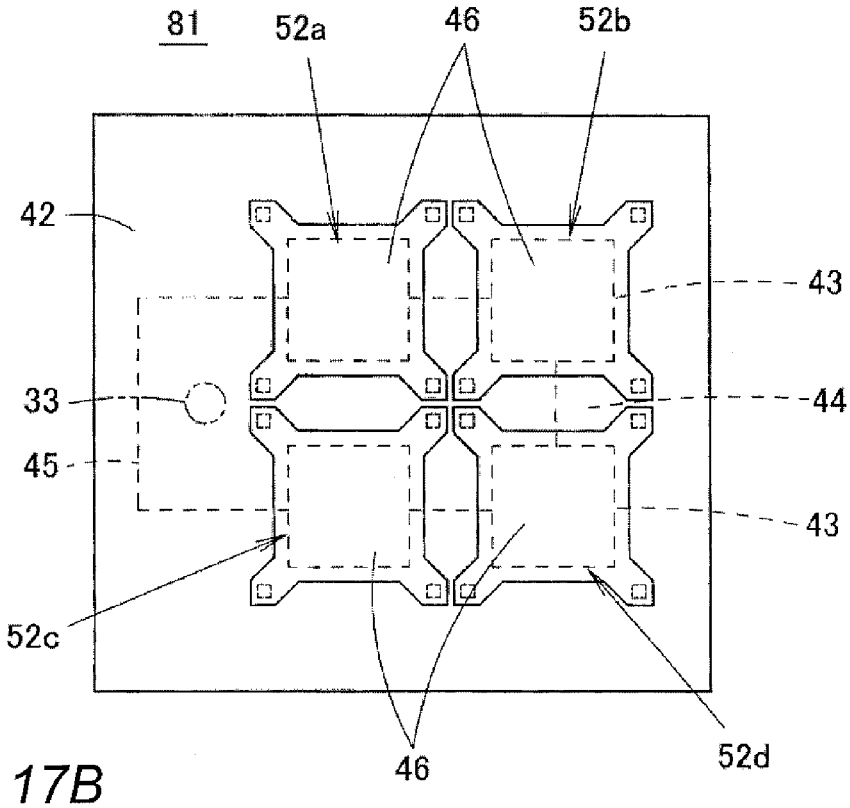
FIG. 17A is a partially-omitted plan view illustrating an acoustic sensor of a second embodiment of the present invention.
Figure 17B:
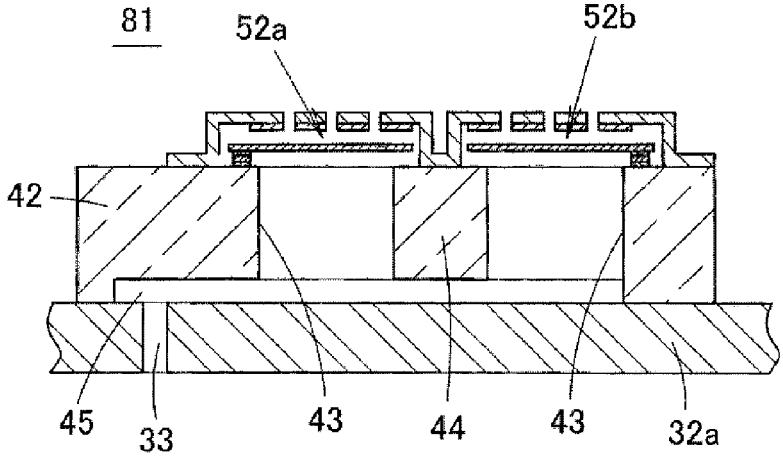
FIG. 17B is a cross section illustrating a state where the acoustic sensor of the second embodiment of the invention is mounted on a package substrate.
Figure 18A:
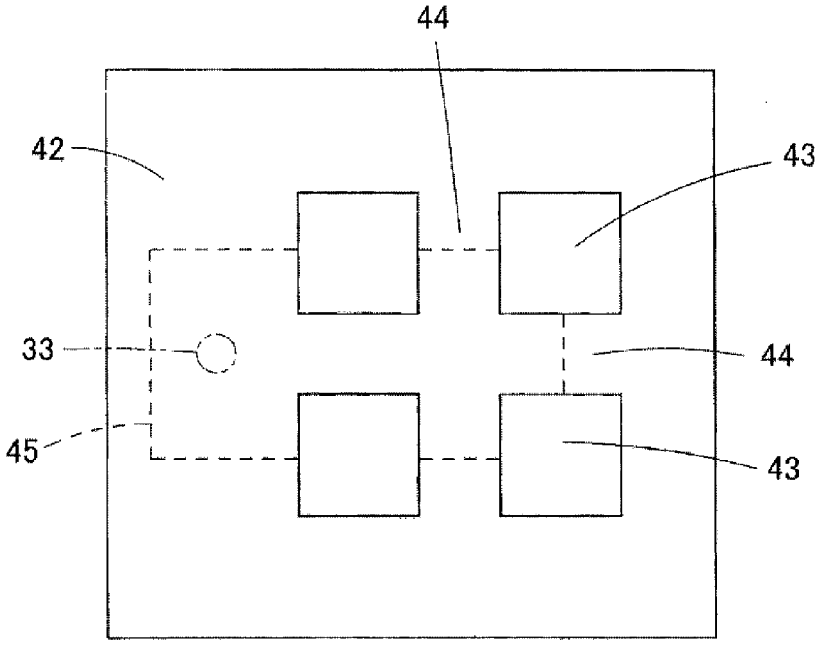
FIGS. 18A and 18B are a plan view and a perspective view from the back side, respectively, of a substrate used for the acoustic sensor of FIG. 17A.
Figure 18B:
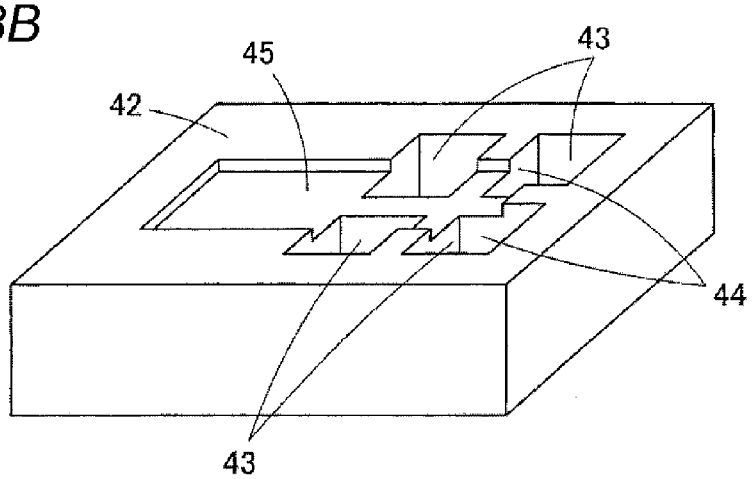

FIG. 17A is a plan view illustrating an acoustic sensor 81 according to a second embodiment of the present invention, and the back plate 49 and the fixed electrode plate 50 are not illustrated. FIG. 17B is a cross section illustrating a state where the acoustic sensor 81 is mounted on the package substrate 32*a*. FIGS. 18A and 18B are a plan view and a perspective view from the back side, respectively, of the substrate 42 used for the acoustic sensor 81.

The substrate 42 used for the acoustic sensor 81 of the second embodiment has a structure as illustrated in FIGS. 18A and 18B. In the partition wall 44 (flat wall part) in three directions viewed from above, the acoustic space 45 extends from the center portion of the partition wall 44 to almost center of the flat wall portion positioned between the front chambers 43. In the partition wall 44 in one direction, the acoustic space 45 extends from the center part of the partition wall 44, passing through the end of the flat wall part between the front chambers 43, to the outside of the partition wall 44 (that is, the outer periphery of the substrate 42). Therefore, the acoustic space 45 has an area wider than that in the case of the first embodiment.

Figure 19:
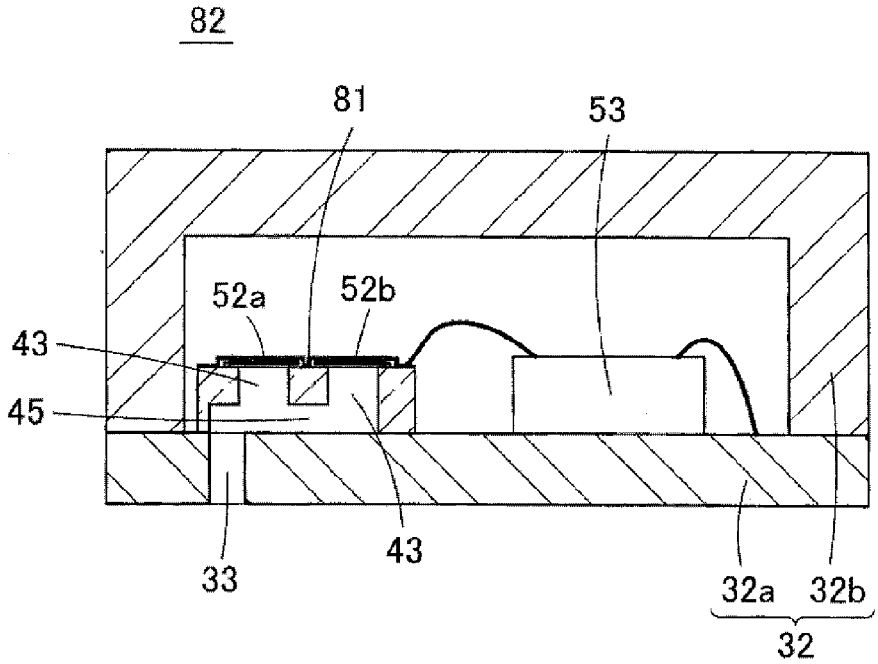
FIG. 19 is a cross section of a microphone incorporating the acoustic sensor of FIG. 17B.

FIG. 19 is a cross section of a microphone 82 having therein the acoustic sensor 81 and the process circuit 53. In the microphone 82, as illustrated in FIGS. 17A and 17B, the package sound hole 33 is opened in the package substrate 32*a* so as to be opposed to a region extended to the outside of the partition wall 44 in the acoustic space 45.

In such an embodiment, the area of the acoustic space 45 is wide, so that the package sound hole 33 can be provided so as to be communicated with the acoustic space 45 not only in the region opposed to the under surface of the partition wall 44 but also in the outer periphery of the under surface of the substrate. Therefore, the freedom degree of the position of providing the package sound hole 33 is high. In particularly, as illustrated in FIG. 19, the package sound hole 33 can be positioned at an end of the acoustic sensor 41. In this case, as illustrated in FIGS. 17B and 18A, by widening the area of the region positioned in the under surface of the outer periphery of the substrate 42 in the acoustic space 45 and making the package sound hole 33 opposed, tolerance for a positional deviation of the package sound hole 33 becomes high.

Since the other points are similar to those of the first embodiment, by designating the same reference numerals to the same components, the description will not be repeated (also in the following embodiments).

Third Embodiment

Figure 20A:
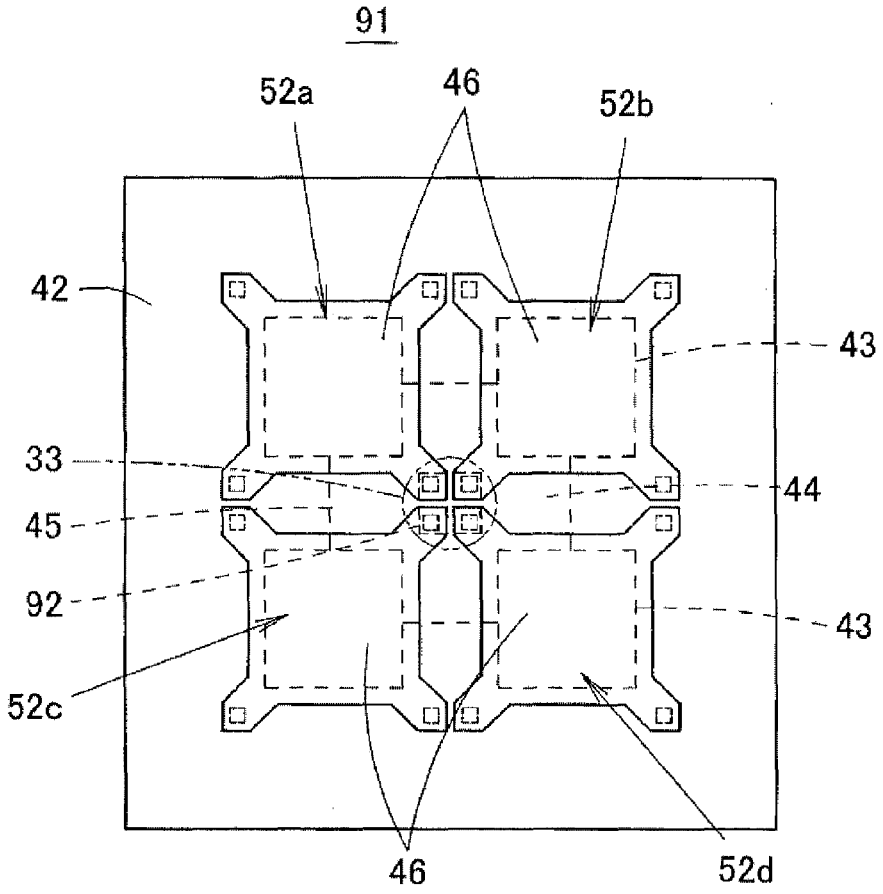
FIG. 20A is a partially-omitted plan view illustrating an acoustic sensor of a third embodiment of the present invention.
Figure 20B:
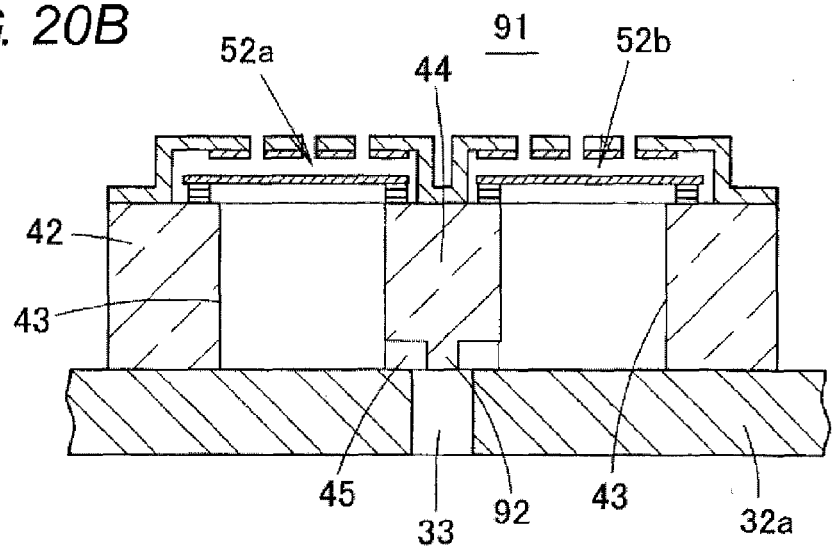
FIG. 20B is a cross section illustrating a state where the acoustic sensor of the third embodiment of the invention is mounted on a package substrate.
Figure 21:
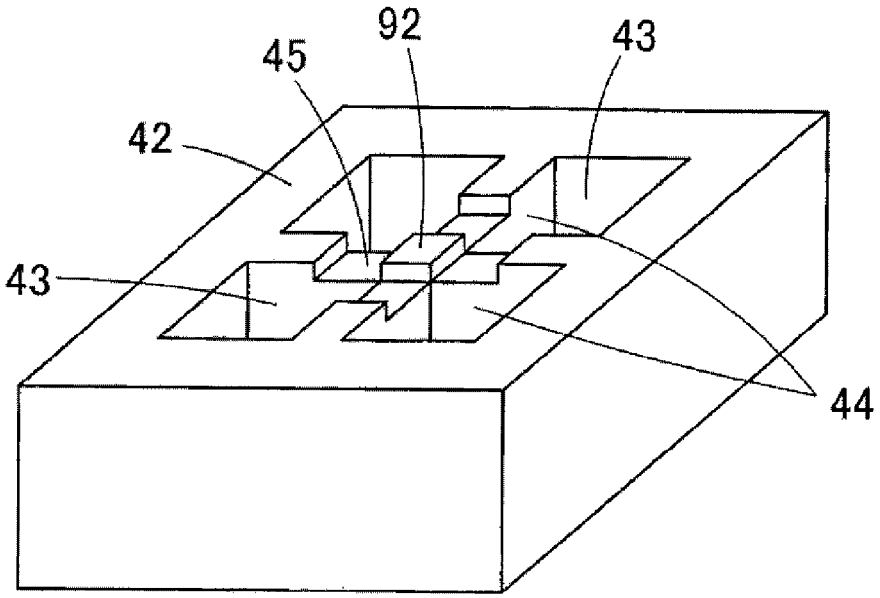
FIG. 21 is a perspective view from the back side illustrating a substrate used for the acoustic sensor of FIG. 20A.

FIG. 20A is a partly-omitted plan view illustrating an acoustic sensor 91 according to a third embodiment of the present invention. FIG. 20B is a cross section illustrating a state where the acoustic sensor 91 is mounted on the package substrate 32*a*. FIG. 21 is a perspective view from the back side illustrating the substrate 42 used for the acoustic sensor 91.

The substrate 42 used for the acoustic sensor 91 has a structure as illustrated in FIG. 21. In the third embodiment, the acoustic space 45 is provided in a region in the under surface of the partition wall 44 except for the intersecting part positioned in the center part of the under surface. In the center part (the intersecting part) of the under surface of the partition wall 44, a supporting column 92 is formed on the under surface of the partition wall 44. The under surface of the supporting column 92 is positioned in the same plane of the under surface of the substrate 42, and the supporting column 92 is surrounded on four sides by the acoustic space 45.

In the illustrated example, the supporting column 92 is positioned on the package sound hole 33. However, it may be positioned on the outside of the package sound hole 33. Alternatively, a plurality of supporting columns 92 may be provided. In the case of providing the supporting column 92 on the package sound hole 33, the area of the supporting column 92 has to be smaller than the opening area of the package sound hole 33 so that the package sound hole 33 is not covered by the supporting column 92.

In the acoustic sensor 91, the supporting column 92 is projected from the under surface of the partition wall 44. Consequently, the rigidity of the substrate 42 is higher, tolerance to an impact or the like on the acoustic sensor 91 increases and, in particular, the diaphragm 46 is not easily broken. In addition, the process volume at the time of etching the substrate 42 to form the acoustic space 45 and the like decreases, so that the etching time is further shortened, and the productivity of the acoustic sensor 91 improves.

The acoustic sensor 91 of the third embodiment as described above can be manufactured by a manufacturing method similar to the first to third manufacturing methods of the first embodiment by covering the region which becomes the projected part 92 with a mask in the step of forming the acoustic space 45 by etching.

Fourth Embodiment

Figure 22A:
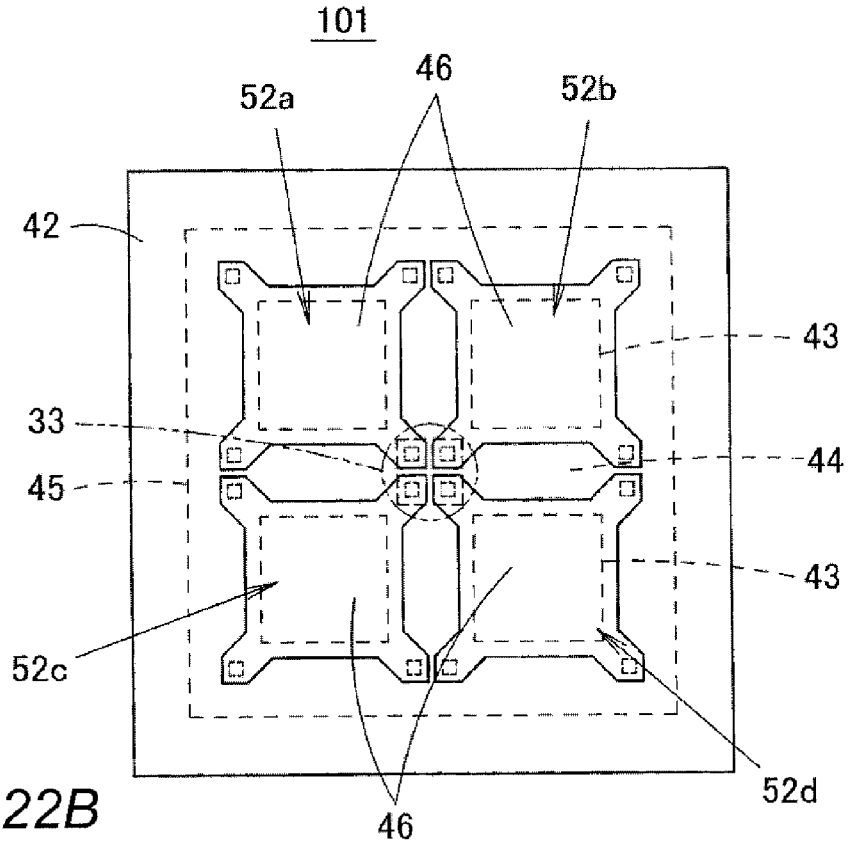
FIG. 22A is a partially-omitted plan view illustrating an acoustic sensor of a fourth embodiment of the present invention.
Figure 22B:
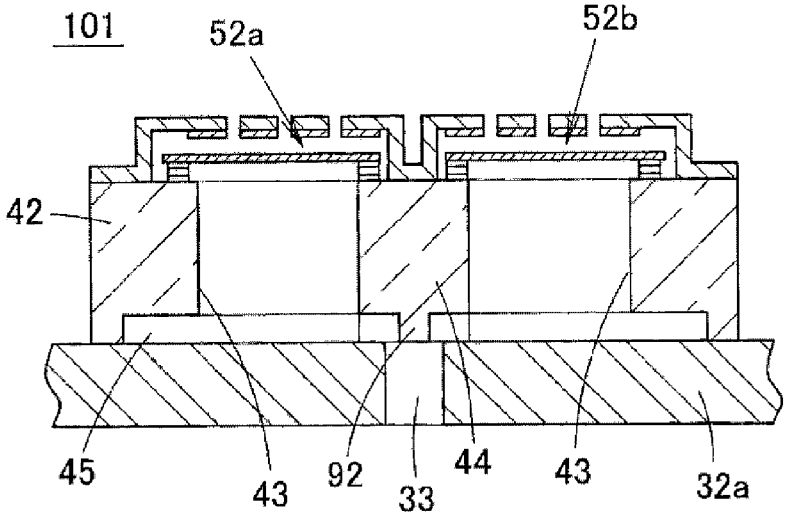
FIG. 22B is a cross section illustrating a state where the acoustic sensor of the fourth embodiment of the invention is mounted on a package substrate.
Figure 23:
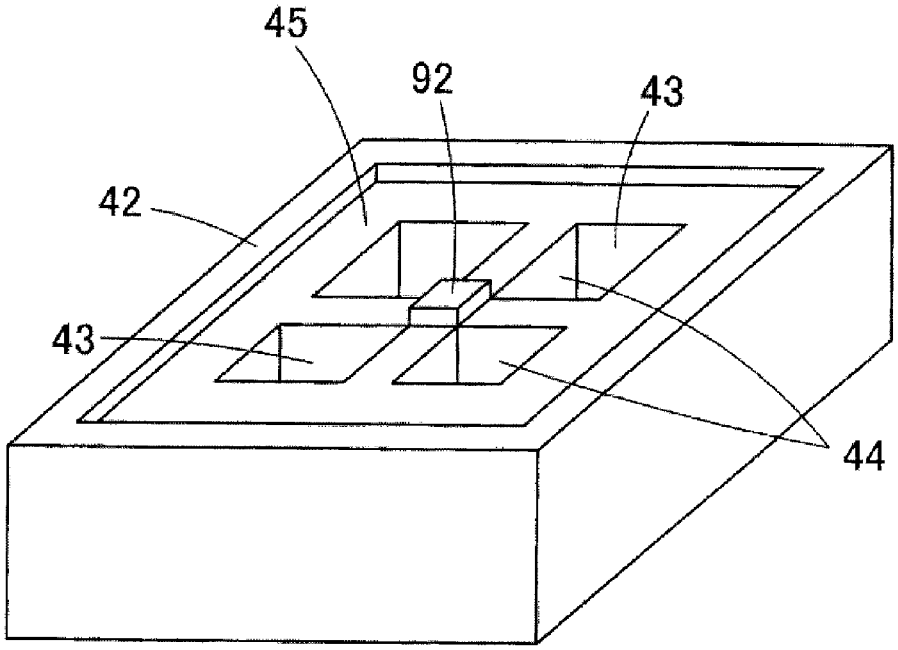
FIG. 23 is a perspective view from the back side illustrating a substrate used for the acoustic sensor of FIG. 22A.

FIG. 22A is a partially-omitted plan view illustrating an acoustic sensor 101 according to a fourth embodiment of the present invention. FIG. 22B is a cross section illustrating a state where the acoustic sensor 101 is mounted on the package substrate 32*a*. FIG. 23 is a perspective view from the back side illustrating the substrate 42 used for the acoustic sensor 101.

The substrate 42 used for the acoustic sensor 101 has a structure as illustrated in FIG. 23. In the fourth embodiment, the acoustic space 45 is provided for the region in the under surface of the partition wall 44 except for the intersecting part positioned in the center part of the under surface. Further, the acoustic space 45 is provided also in a region surrounding the front chambers 43 and the partition wall 44 (the outer peripheral region of the under surface of the substrate 42). The supporting column 92 is provided on the under surface of the partition wall 44.

In the acoustic sensor 101, the acoustic space 45 is wide, so that the freedom degree of the position of providing the package sound hole 33 becomes high. Particularly, as illustrated in FIG. 9, the package sound hole 33 can be positioned at an end of the acoustic sensor 41. Since the supporting column 92 is projected from the under surface of the partition wall 44, the rigidity of the substrate 42 is higher, tolerance to an impact or the like on the acoustic sensor 91 increases and, in particular, the diaphragm 46 is not easily broken.

(Other Substrate Shapes)

Figure 24A:
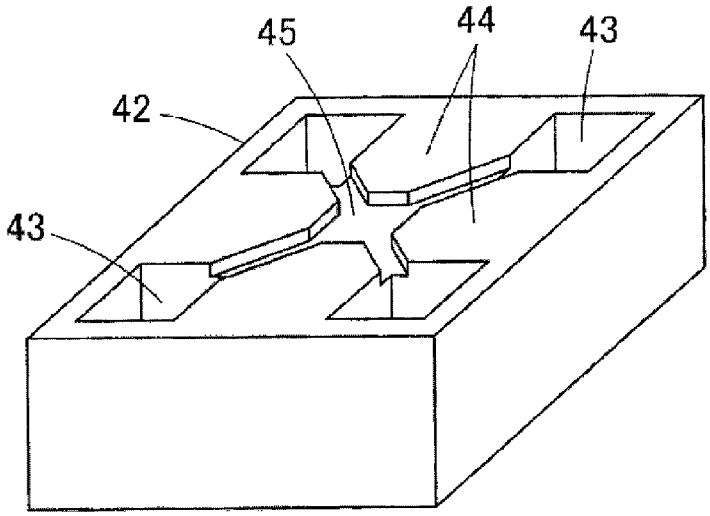
FIGS. 24A and 24B are a perspective view from the back side and a plan view, respectively, of a substrate having a different shape.
Figure 24B:
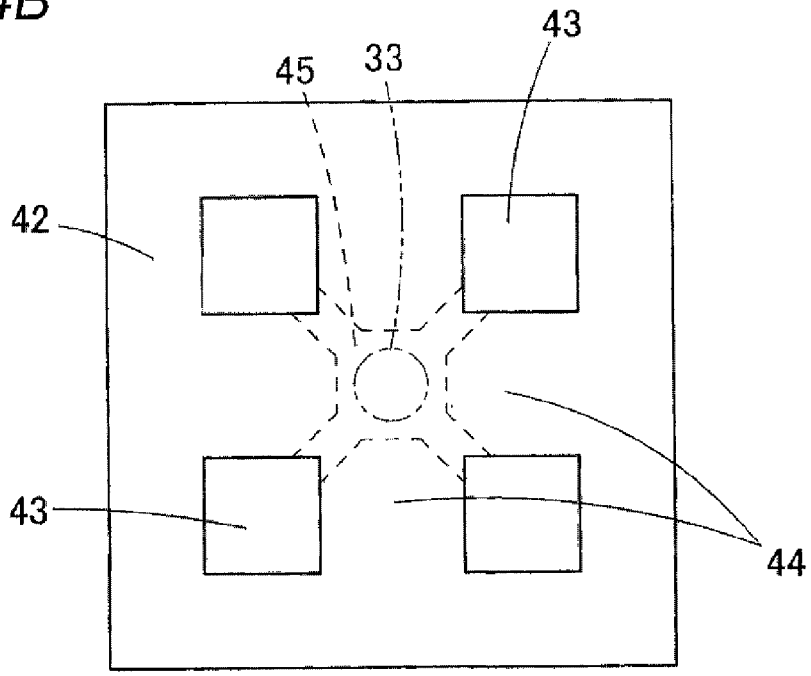

Besides the above substrate shapes, various substrate shapes (or acoustic space structures) can be employed. For example, in the substrate 42 illustrated in FIGS. 24A and 24B, the acoustic space 45 extending in the diagonal directions is provided below the under surface of the partition walls 44. The package sound hole 33 is disposed so as to be opposed to the center part (intersecting part) of the acoustic space 45.

In the substrate 42 illustrated in FIG. 25A, the acoustic spaces 45 extending in the wall thickness direction are provided below the under surface of the partition walls 44 so as to connect the neighboring front chambers 43 to each other. The package sound hole 33 is disposed so as to be opposed to an opening in the under surface of any one of the front chambers 43. Also in such a form, the front chambers 43 are communicated with one another via the acoustic spaces 45 or the acoustic space 45 and the front chamber 43 therebetween. The package sound hole 33 can be provided in a position opposed to the front chamber 43 when the possibility of intrusion of dust and the like from the package sound hole 33 into the front chambers 43 is not considered.

Figure 25A:
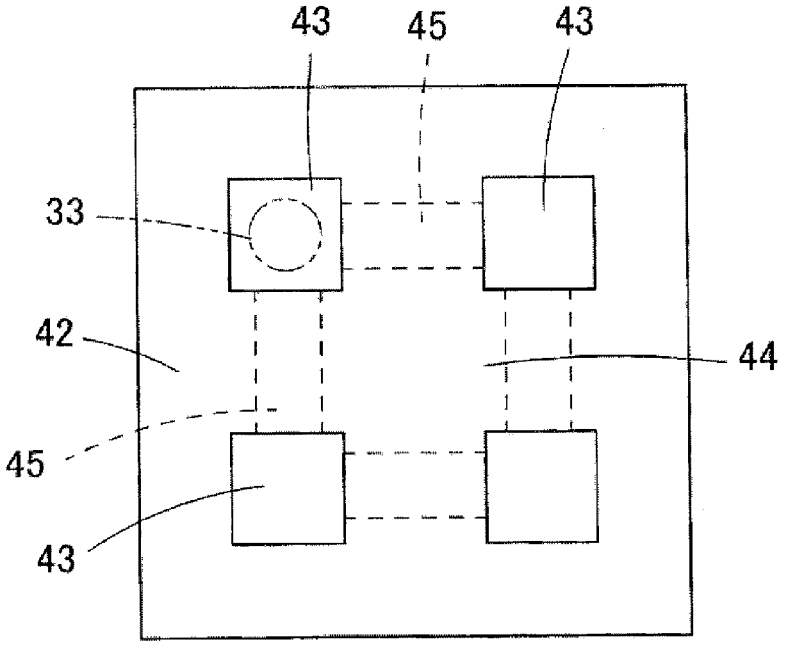
FIGS. 25A and 25B are plan views each illustrating a substrate of further another shape.
Figure 25B:
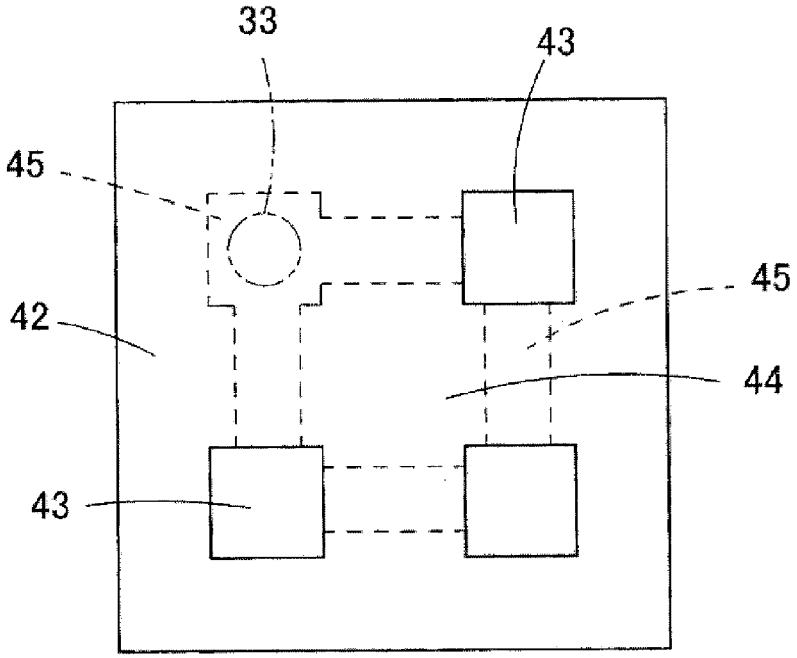

In the substrate 42 illustrated in FIG. 25B, one of the front chambers 43 in the substrate 42 of FIG. 25A is not provided, thereby decreasing the number of front chambers 43, and the acoustic space 45 is provided below the under surface of the substrate 42 in the position of the front chamber 43 reduced.

Figure 26A:
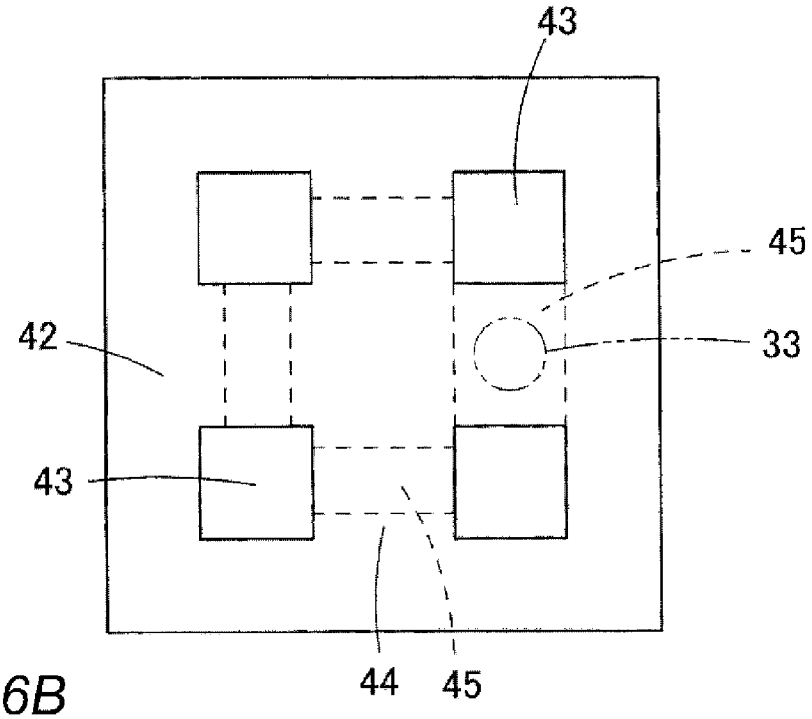
FIGS. 26A and 26B are plan views each illustrating a substrate of further another shape.

In the substrate illustrated in FIG. 26A, the acoustic space 45 is provided below the under surface of the partition wall 44 so as to connect the neighboring front chambers 43, and the package sound hole 33 is disposed so as to be opposed to any of the acoustic spaces 45 between the front chambers 43. In the substrate of FIG. 26A, the acoustic space 45 to which the package sound hole 33 is opposed is set to be wider than the other acoustic spaces 45.

Figure 26B:
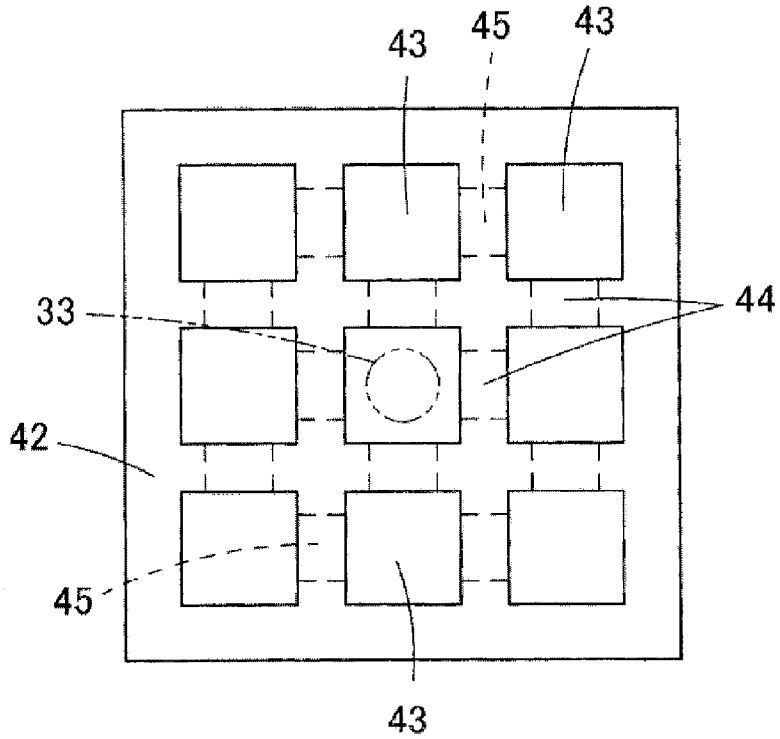

The number of front chambers 43 provided for the substrate 42 may be more than four. For example, as illustrated in FIG. 26B, a number of front chambers 43 may be disposed in a rectangular shape and the acoustic spaces 45 may be provided below the under surface of the partition walls 44 so as to connect neighboring front chambers 43. In this case, the package sound hole 33 may be disposed so as to be opposed either to the opening in the under surface of any of the front chambers 43 or to the acoustic space 45.

Fifth Embodiment

Figure 27:
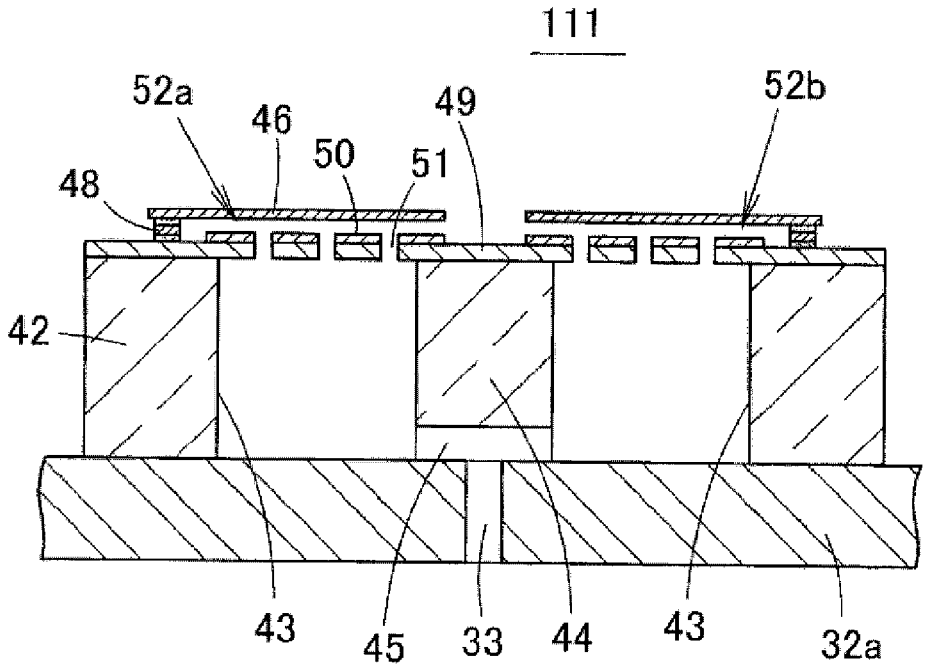
FIG. 27 is a cross section illustrating a state where an acoustic sensor of a fifth embodiment of to the present invention is mounted on a package substrate.

FIG. 27 is a cross section illustrating a state where an acoustic sensor 111 according to a fifth embodiment of the present invention is mounted on the package substrate 32*a*. In one or more of the embodiments and modification described above, the fixed electrode plate 50 is provided above the diaphragm 46. The fixed electrode plate 50 and the diaphragm 46 may be disposed opposite to each other in the vertical direction. Specifically, in the acoustic sensor 111 illustrated in FIG. 27, the back plate 49 is disposed on the top surface of the substrate 42, and the fixed electrode plate 50 is provided on the top surface of the back plate 49 above the front chambers 43. In the back plate 49 and the fixed electrode plate 50, a number of acoustic holes 51 are opened. The diaphragm 46 is disposed above each of the fixed electrode plates 50 so as to be opposed to the fixed electrode plate 50, and the corners of the diaphragm 46 are supported by the top surface of the back plate 49 by the anchors 48.

In the acoustic sensor 111, acoustic oscillation which enters from the package sound hole 33, passes through the acoustic space 45, and enters the front chambers 43 passes through the acoustic holes 51, oscillates the diaphragms 46, and changes the capacitance between the diagraphs 46 and the fixed electrode plates 50.

Sixth Embodiment

Figure 28A:
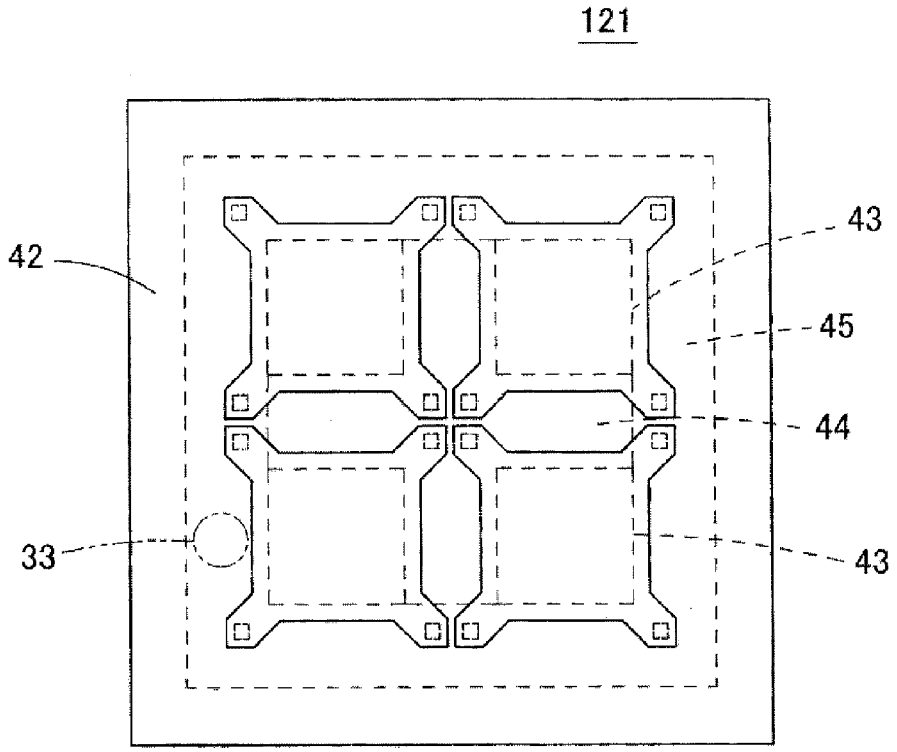
FIG. 28A is a partially-omitted plan view illustrating an acoustic sensor of a sixth embodiment of to the present invention.
Figure 28B:
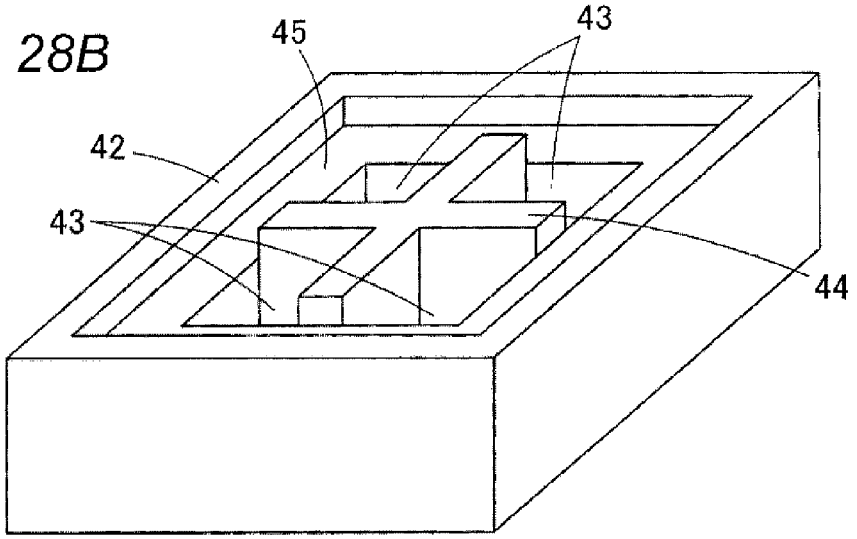
FIG. 28B is a perspective view from the back side illustrating a substrate used for the acoustic sensor of FIG. 28A.

FIG. 28A is a partially-omitted plan view illustrating an acoustic sensor 121 according to a sixth embodiment of the present invention. FIG. 28B is a perspective view from the back side illustrating the substrate 42 used for the acoustic sensor 121.

The substrate 42 used for the acoustic sensor 121 has a structure as illustrated in FIGS. 28A and 28B. In the sixth embodiment, in the region on the outside of the front chambers 43 and the partition walls 44, the acoustic space 45 is provided below the under surface of the substrate 42. In the illustrated example, the acoustic space 45 having a frame shape is provided so as to surround the lower part of the front chambers 43 and the partition walls 44. The acoustic space 45 has a sectional shape of a rectangular groove and is communicated with the front chambers 43 on its inner peripheral side faces. The under surface of the partition wall 44 is positioned in the same plane as the under surface of the substrate 42. In the sixth embodiment, the partition wall 44 is tall, so that the rigidity of the substrate 42 is higher.

The acoustic sensor may be fixed on the inner face of the cover of the package in a state where it is upside down. In this case, the package sound hole is opened in the cover in the position opposed to the acoustic space of the acoustic sensor.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A microphone comprising:
a package; and
an acoustic sensor, an under surface of which is fixed to an inner face of the package,
wherein the acoustic sensor comprises:
a substrate having a plurality of hollows penetrating the substrate from a top surface to an under surface, and
a capacitor structure made by a movable electrode plate and a fixed electrode plate disposed above each of the hollows,
wherein a package sound hole is opened in the package in a position opposed to the under surface of the acoustic sensor,
wherein a dent which is communicated with each of the hollows and open below the under surface side of the substrate is formed below the under surface of the substrate, and
wherein a height of the dent measured from the under surface of the substrate is equal to or less than half of a height of the hollow.

2. The microphone according to claim 1,
wherein the hollows are separated from each other by a partition wall of the substrate,
wherein the dent is formed at least in a portion of an under surface of the partition wall in the under surface of the substrate, and
wherein the dent is communicated with a side face of a lower end of each of the hollows.

3. The microphone according to claim 2, wherein the dent is formed at least in a portion of the under surface of the partition wall.

4. The microphone according to claim 2, wherein a supporting column is projected from a portion of the under surface of the partition wall.

5. The microphone according to claim 4, wherein the under surface of the supporting column is positioned in the same plane as the under surface of the substrate.

6. The microphone according to claim 1, wherein the package sound hole is opposed to the under surface of any one of the plurality of hollows.

7. The microphone according to claim 1,
wherein the hollows are separated from one another by the partition walls of the substrate,
wherein the dent is formed at least in a portion of the under surface of a region other than the hollows and the partition walls in the under surface of the substrate, and
wherein the dent is communicated with a side face of a lower end of each of the hollows.

8. The microphone according to claim 7, wherein the package sound hole is opposed to the under surface of the region other than the hollows and the partition walls.

9. The microphone according to claim 1, wherein the entire periphery of the dent is surrounded by the substrate.

10. A microphone comprising:
a package; and
an acoustic sensor, an under surface of which is fixed to an inner face of the package,
wherein the acoustic sensor comprises:
a substrate having a plurality of hollows penetrating the substrate from a top surface to an under surface, and
a capacitor structure made by a movable electrode plate and a fixed electrode plate disposed above each of the hollows,
wherein a package sound hole is opened in the package in a position opposed to the under surface of the acoustic sensor,
wherein a dent which is communicated with each of the hollows and open below the under surface side of the substrate is formed below the under surface of the substrate,
wherein a height of the dent measured from the under surface of the substrate is equal to or less than half of a height of the hollow,
wherein the hollows are separated from each other by a partition wall of the substrate,
wherein the dent is formed at least in a portion of an under surface of the partition wall in the under surface of the substrate,
wherein the dent is communicated with a side face of a lower end of each of the hollows, and
wherein the package sound hole is opposed to the under surface of the partition wall.

* * * * *